US012022989B2

(12) United States Patent
Der Marderosian et al.

(10) Patent No.: US 12,022,989 B2
(45) Date of Patent: Jul. 2, 2024

(54) NOZZLE FOR A SURFACE TREATMENT APPARATUS AND A SURFACE TREATMENT APPARATUS HAVING THE SAME

(71) Applicant: SHARKNINJA OPERATING LLC, Needham, MA (US)

(72) Inventors: Daniel R. Der Marderosian, Westwood, MA (US); Nathan Herrmann, Middlebury, VT (US); Max P. Lacoma, Needham, MA (US); Devan Schappler, Needham, MA (US); Adam Udy, Sutton (GB); Donald Williams, Needham, MA (US); Hanzon R. Hunt, Sugar Hill, NH (US)

(73) Assignee: SharkNinja Operating LLC, Needham, MA (US)

( * ) Notice: Subject to any disclaimer, the term of this patent is extended or adjusted under 35 U.S.C. 154(b) by 404 days.

(21) Appl. No.: 17/125,197

(22) Filed: Dec. 17, 2020

(65) Prior Publication Data

US 2021/0177223 A1 Jun. 17, 2021

Related U.S. Application Data

(60) Provisional application No. 62/949,122, filed on Dec. 17, 2019.

(51) Int. Cl.
*A47L 9/06* (2006.01)
*A47L 9/00* (2006.01)

(52) U.S. Cl.
CPC ..... *A47L 9/0606* (2013.01); *A47L 9/009* (2013.01); *A47L 2201/00* (2013.01)

(58) Field of Classification Search
CPC . A47L 9/0477; A47L 9/04; A47L 9/06; A47L 9/0693; A47L 9/0606;
(Continued)

(56) References Cited

U.S. PATENT DOCUMENTS 4,008,505 A 2/1977 Clowers
4,457,045 A * 7/1984 Kegg ..... B60B 33/0052 16/48
(Continued)

FOREIGN PATENT DOCUMENTS

CN 105392407 3/2016
DE 1967828 9/1967
(Continued)

OTHER PUBLICATIONS

Machine translation of WO-2009133031-A1 (Year: 2009).*
(Continued)

*Primary Examiner* — Tom Rodgers
*Assistant Examiner* — Robert F Neibaur
(74) *Attorney, Agent, or Firm* — Grossman Tucker Perreault & Pfleger, PLLC

(57) ABSTRACT

A nozzle having castellations provides high suction pressure while also allowing for large pieces of debris to pass through inlet openings. In more detail, a nozzle for a surface treatment/cleaning apparatus is disclosed herein. The nozzle provides a suction channel through which debris passes into a main body of the surface treatment apparatus. Castellations are provided along a leading edge of the nozzle to allow debris to pass through the leading edge to the suction channel, and into the main body during, for instance, forward and reverse strokes of the surface treatment apparatus. In an embodiment, the castellations further include receptacles/cavities to receive and securely hold wheels therein. The wheels may extend from the nozzle at a predefined angle, also referred to herein as a camber angle, to improve vacuum handling and reduce noise during operation.

12 Claims, 21 Drawing Sheets

(58) Field of Classification Search
CPC ..... A47L 9/0613; A47L 9/02–066; A47L 11/4041; A47L 11/4044; A47L 2201/00
USPC ..... 15/420, 375, 378, 415.1, 421, 422
See application file for complete search history.

(56) References Cited

U.S. PATENT DOCUMENTS

| | | | |
|---|---|---|---|
| 5,029,361 | A | 7/1991 | Murata et al. |
| 5,123,141 | A | 6/1992 | Erickson et al. |
| 6,539,575 | B1 | 4/2003 | Cohen |
| 8,533,905 | B1 | 9/2013 | Tran |
| 9,681,785 | B2 | 6/2017 | Kleine-Doepke et al. |
| 10,631,702 | B2 | 4/2020 | Xia et al. |
| 10,646,083 | B2 * | 5/2020 | Kim ..... A47L 5/362 |
| 2008/0086837 | A1 | 4/2008 | Son et al. |
| 2008/0120803 | A1 | 5/2008 | Bryant |
| 2009/0229075 | A1 | 9/2009 | Eriksson |
| 2010/0299863 | A1 | 12/2010 | Dewing |
| 2014/0352104 | A1 | 12/2014 | Eriksson |
| 2015/0059122 | A1 | 3/2015 | Kim et al. |
| 2015/0223655 | A1 | 8/2015 | Cole et al. |
| 2016/0174792 | A1 | 6/2016 | Williamson et al. |
| 2017/0007086 | A1 | 1/2017 | Kleine-Doepke et al. |
| 2017/0280957 | A1 | 10/2017 | Jeong et al. |
| 2017/0325646 | A1 | 11/2017 | Kim et al. |
| 2018/0255991 | A1 | 9/2018 | Der Marderosian et al. |
| 2019/0298052 | A1 | 10/2019 | Conrad et al. |
| 2019/0298125 | A1 | 10/2019 | Conrad et al. |
| 2019/0307302 | A1 | 10/2019 | Zheng et al. |
| 2020/0046183 | A1 | 2/2020 | Choi et al. |
| 2020/0121144 | A1 | 4/2020 | Gacin et al. |
| 2021/0068602 | A1 | 3/2021 | Carter |
| 2021/0094077 | A1 | 4/2021 | Kane et al. |

FOREIGN PATENT DOCUMENTS

| | | | | |
|---|---|---|---|---|
| JP | 2017502773 | | 1/2017 | |
| KR | 20180080657 | A * | 7/2018 | |
| WO | WO-2009133031 | A1 * | 11/2009 | ..... A47L 9/06 |

OTHER PUBLICATIONS

Machine translation of KR-20180080657-A (Year: 2018).*
PCT Search Report and Written Opinion dated Mar. 18, 2021, received in corresponding PCT Application No. PCT/US20/65591, 10 pages.
PCT Search Report and Written Opinion dated Nov. 17, 2021, received in PCT Application No. PCT/US21/43730, 10 pages.
Chinese Notification of Office Action with English summary dated Feb. 21, 2023, received in Chinese Patent Application No. 202080087870.0, including chart on p. 10 of the Notification, 13 pages.
U.S. Office Action dated Jan. 25, 2023, received in U.S. Appl. No. 17/388,883, 15 pages.
Japanese Office Action with machine-generated English translation dated Nov. 28, 2023, received in Japanese Patent Application No. 2023-506277, 10 pages.
Canadian Office Action dated Jun. 30, 2023, received in Canadian Patent Application No. 3,162,078, 6 pages.
Australian Examination Report dated Aug. 11, 2023, received in Australian Patent Application No. 2020405017, 4 pages.
Japanese Office Action with machine-generated English translation dated Aug. 29, 2023, received in Japanese Patent Application No. 2022-537110, 10 pages.
Chinese Office Action with machine-generated English translation dated Aug. 31, 2023, received in Chinese Patent Application No. 202080087870.0, 21 pages.

* cited by examiner

NOZZLE FOR A SURFACE TREATMENT APPARATUS AND A SURFACE TREATMENT APPARATUS HAVING THE SAME

CROSS REFERENCE TO RELATED APPLICATIONS

The present application claims the benefit of U.S. Provisional Application Ser. No. 62/949,122 filed on Dec. 17, 2019, entitled NOZZLE FOR A SURFACE TREATMENT APPARATUS AND A SURFACE TREATMENT APPARATUS HAVING THE SAME, which is fully incorporated herein by reference.

TECHNICAL FIELD

The present disclosure relates generally to a vacuum cleaner, and more particularly, to a vacuum cleaner nozzle including castellations and/or cambered wheels to maintain suction power while collecting relatively large debris (e.g., cereal) and improve user experience through improved handling and reduction of wheel-induced noise.

BACKGROUND

The following is not an admission that anything discussed below is part of the prior art or part of the common general knowledge of a person skilled in the art.

A vacuum cleaner may be used to clean a variety of surfaces. Some vacuum cleaners include a nozzle with a castellated configuration such that dirt and debris gets drawn into a dirty air inlet via a plurality of different inlets (or inlet paths). Such castellated nozzles allow for increased air velocity and higher suction relative to other nozzle configurations. Narrow openings/inlets/channels between castellations generally restrict/confine more area of a suction inlet, and result in higher air velocity during operation. While existing vacuum cleaners with castellated nozzles are generally effective at collecting debris, some larger debris (for example, CHEERIOS™) may not pass through the relatively narrow openings/inlets/channels provided by the nozzle, or worse yet can clog the same. On the other hand, widening the openings/inlets/channels of a castellated nozzle tends to lower air velocity, and by extension, decrease suction power and thus nullify the advantages of having the castellations. Accordingly, vacuums with castellated nozzles may be limited to cleaning applications that do not seek to remove large pieces of debris.

BRIEF DESCRIPTION OF THE DRAWINGS

Embodiments are illustrated by way of example in the accompanying figures, in which like reference numbers indicate similar parts, and in which.

DETAILED DESCRIPTION

Figure 1:
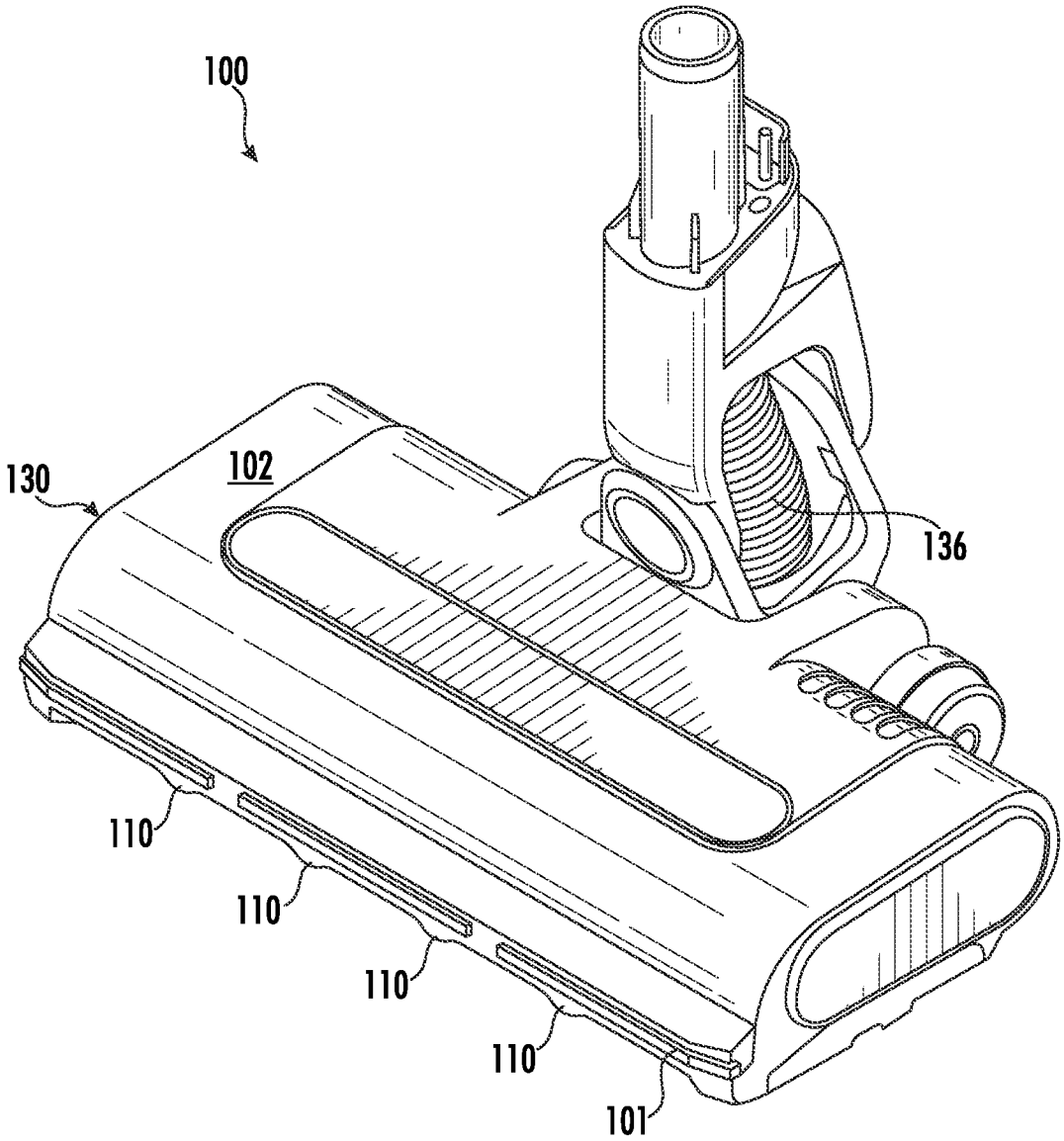
FIG. 1 is an isometric view of one embodiment of a vacuum cleaner nozzle, consistent with embodiments of the present disclosure.

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

As discussed above, vacuums with castellated nozzles benefit from high suction power but are unable to be used in a wide-range of cleaning operations, such as those that aim to remove large bits of debris, for example, having at least one dimension that is equal to or greater than 1.27 cm, such as, but not limited to, a CHEERIOS™. Worse yet, castellated nozzles tend to get easily clogged as debris such as CHEERIOS™ can become lodged within the associated openings/inlets/channels.

Thus, in accordance with an embodiment of the present disclosure, a nozzle having castellations is disclosed herein that provides high suction pressure while also allowing for large pieces of debris to pass through the inlet openings. In more detail, a nozzle for a surface treatment apparatus is disclosed herein. The nozzle provides a suction channel through which debris passes into a main body of the surface treatment apparatus. Castellations are provided along a leading edge of the nozzle to allow debris to pass through the leading edge to the suction channel and into the main body during, for instance, forward and reverse strokes of the surface treatment apparatus.

In an embodiment, the castellations further include receptacles/cavities to receive and securely hold wheels therein. The wheels may be advantageously located at a distance which is offset from the sides of the nozzle. This results in improved edge cleaning as the nozzle 100 can be configured with inlets that allow for side-to-side cleaning movements along, for instance, walls. As discussed in further detail below, the wheels may be configured as a cambered wheels.

Nozzles configured consistent with the present disclosure provide numerous advantages and features over existing nozzle configurations. For instance, the castellations disclosed herein allow for vacuum cleaners implementing the same to be used in a wide-range of cleaning operations, and importantly, cleaning operations that aim to draw in large pieces of debris without getting clogged by the same.

Turning now to FIGS. 1-5, one embodiment of a vacuum cleaner nozzle 100 is generally illustrated. The term vacuum cleaner nozzle as used herein refers to any type of vacuum cleaner nozzle and may be also referred to as a cleaning head, a cleaning nozzle, or simply a nozzle. Such nozzles may be attached to a vacuum cleaner (or any other surface cleaning device) including, but not limited to, hand-operated vacuum cleaners and robot vacuum cleaners. Further non-limiting examples of hand-operated vacuum cleaners include upright vacuum cleaners, canister vacuum cleaners, stick vacuum cleaners, and central vacuum systems. Thus, while various aspects of the present disclosure may be illustrated and/or described in the context of a hand-operated vacuum cleaner or a robot vacuum cleaner, it should be understood the features disclosed herein are applicable to any hand-operated vacuum cleaner, robot vacuum cleaner, and other similar surface cleaning device unless specifically stated otherwise.

Figure 2:
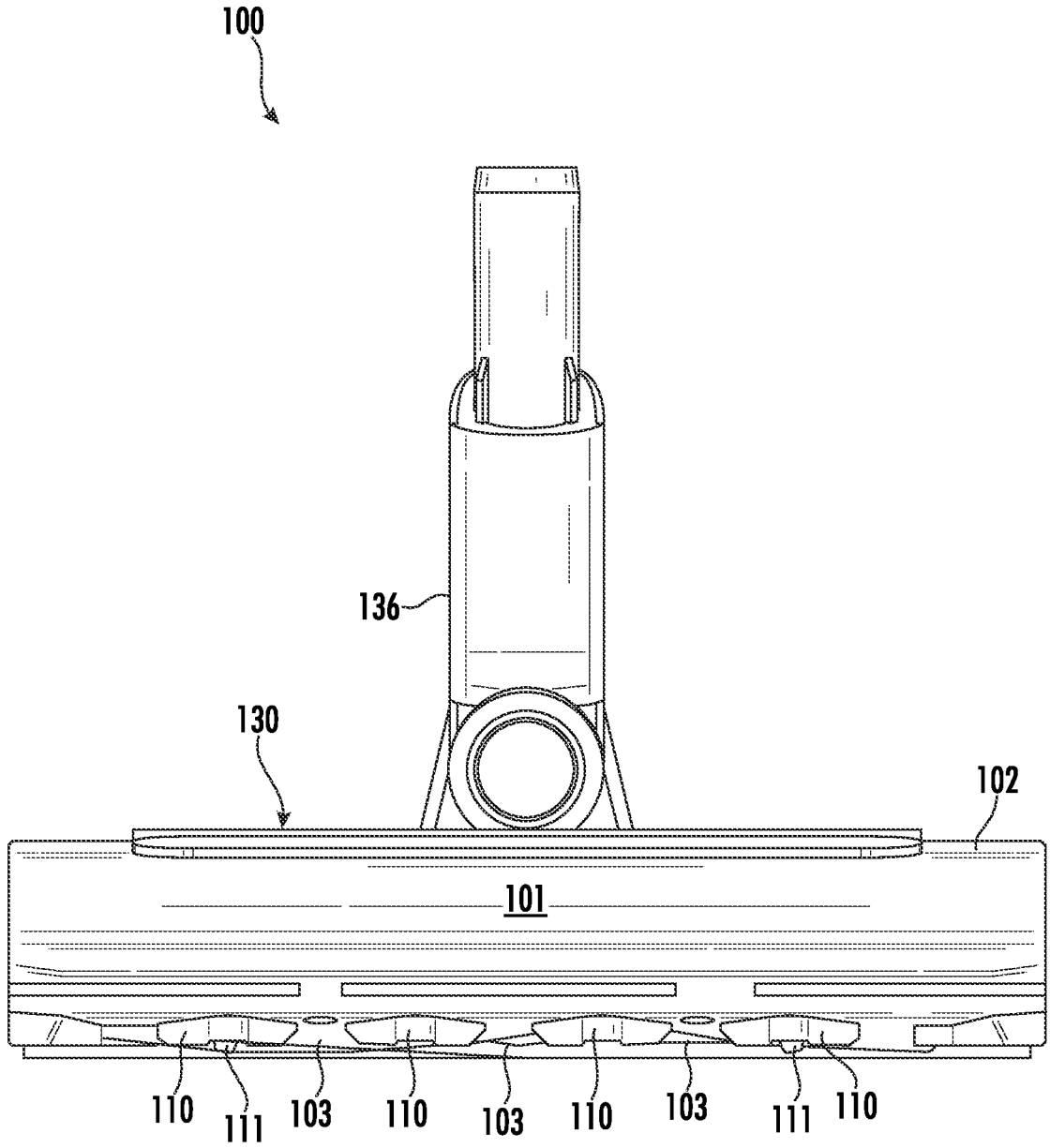
FIG. 2 is a front view of the vacuum cleaner nozzle of FIG. 1, consistent with embodiments of the present disclosure.
Figure 3:
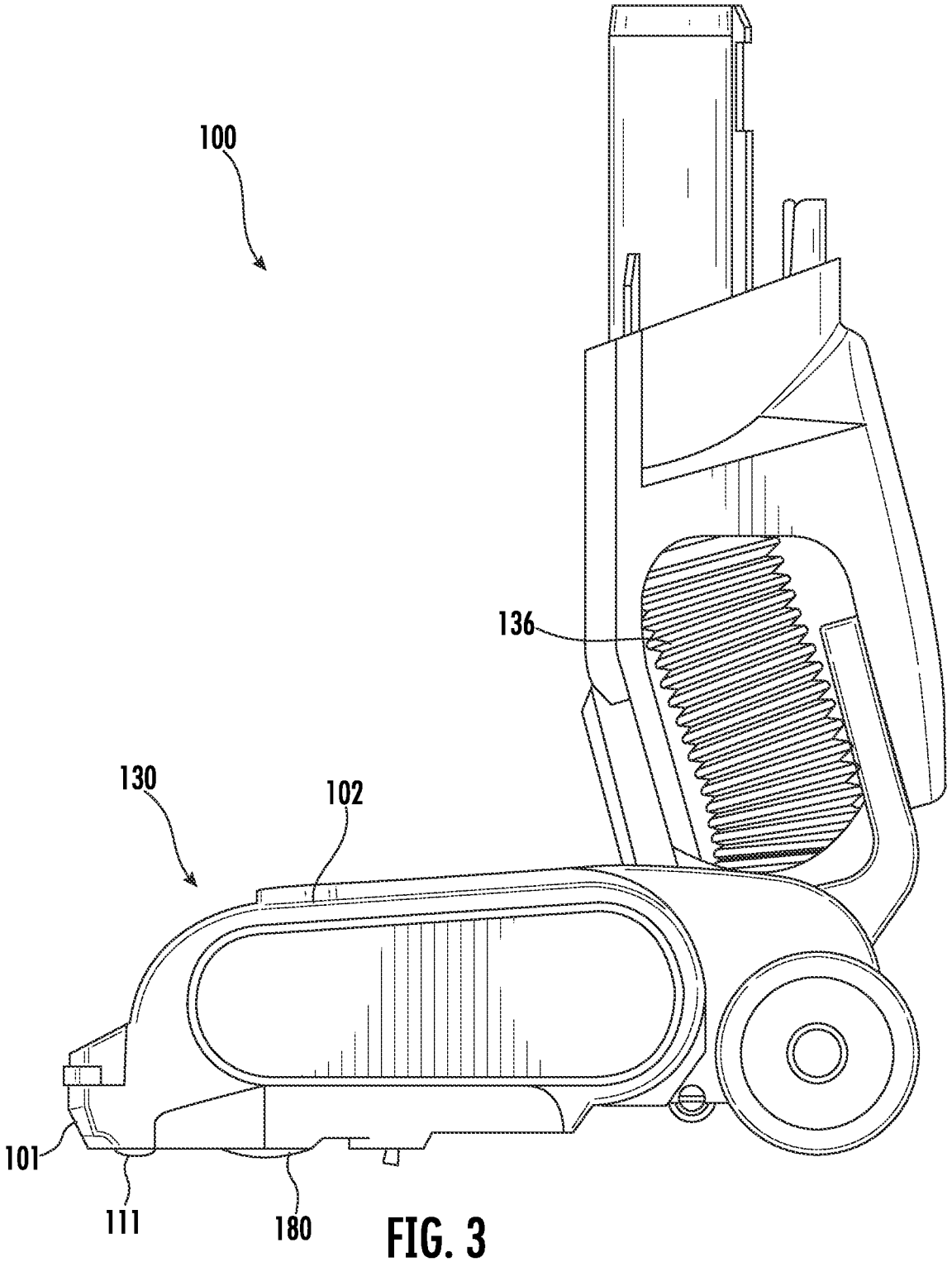
FIG. 3 is a side view of the vacuum cleaner nozzle of FIG. 1, consistent with embodiments of the present disclosure
Figure 4:
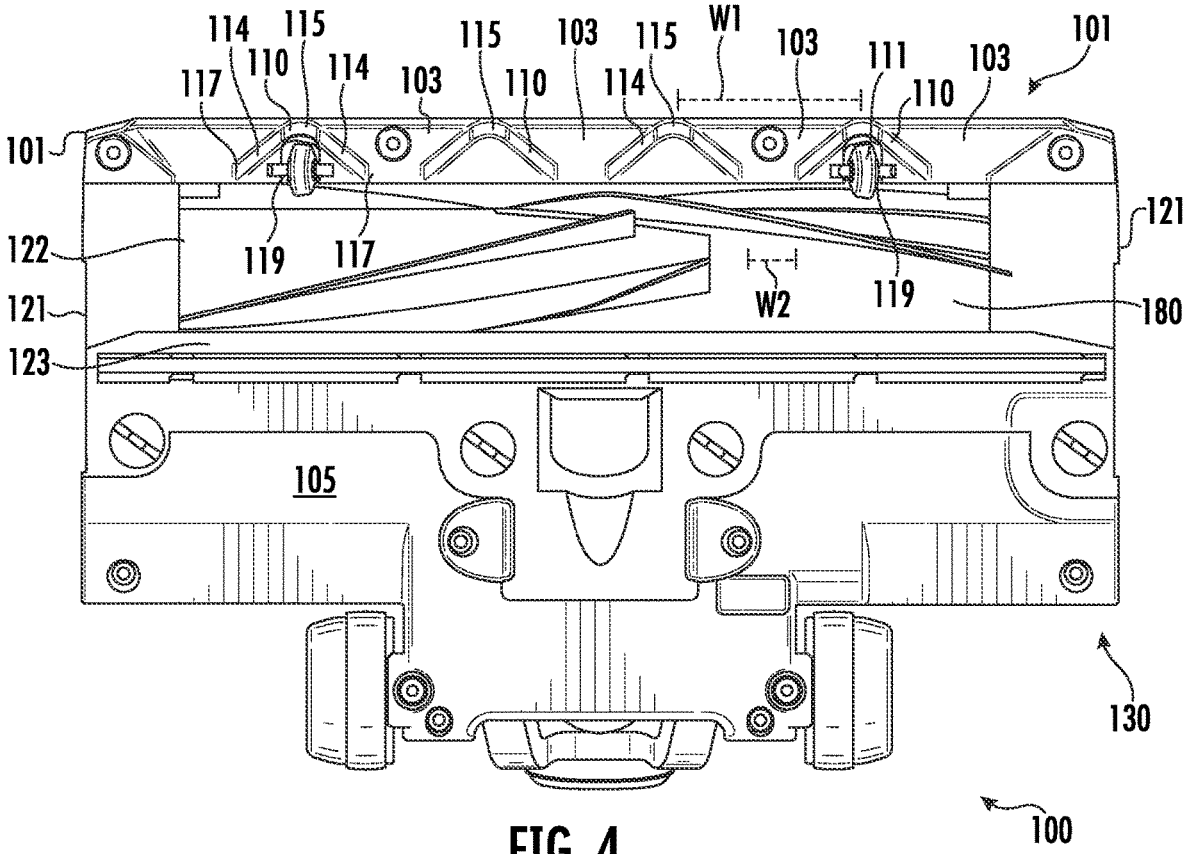
FIG. 4 is a bottom view of the vacuum cleaner nozzle of FIG. 1, consistent with embodiments of the present disclosure.
Figure 5:
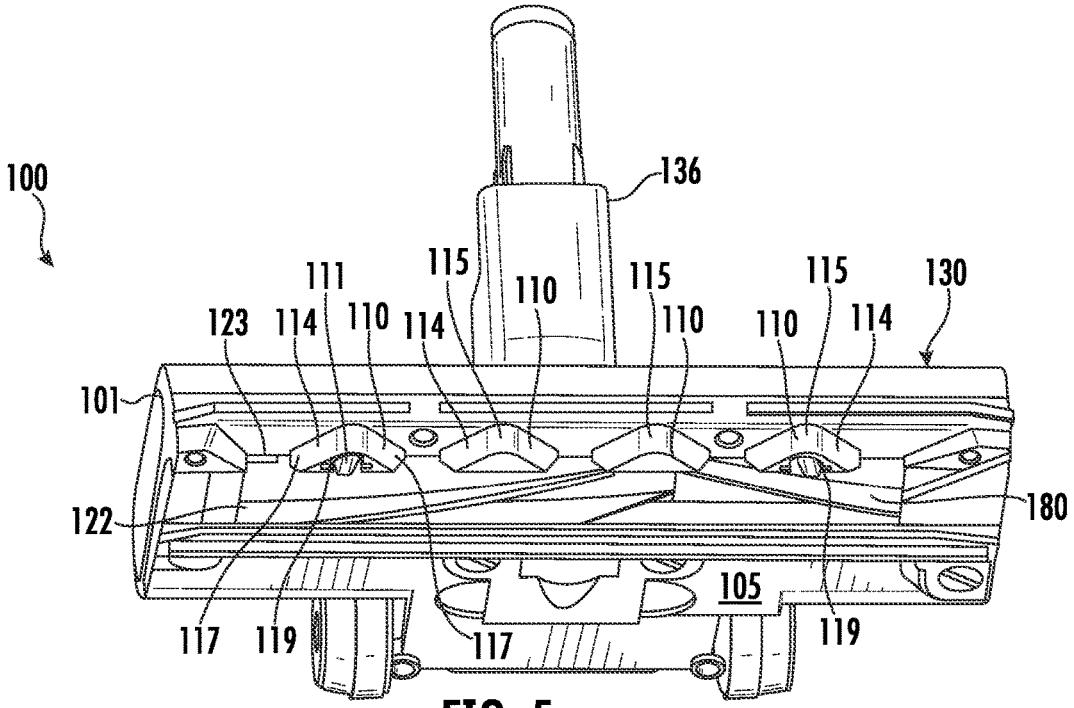
FIG. 5 is a bottom perspective view of the vacuum cleaner nozzle of FIG. 1, consistent with embodiments of the present disclosure.
Figure 6A:
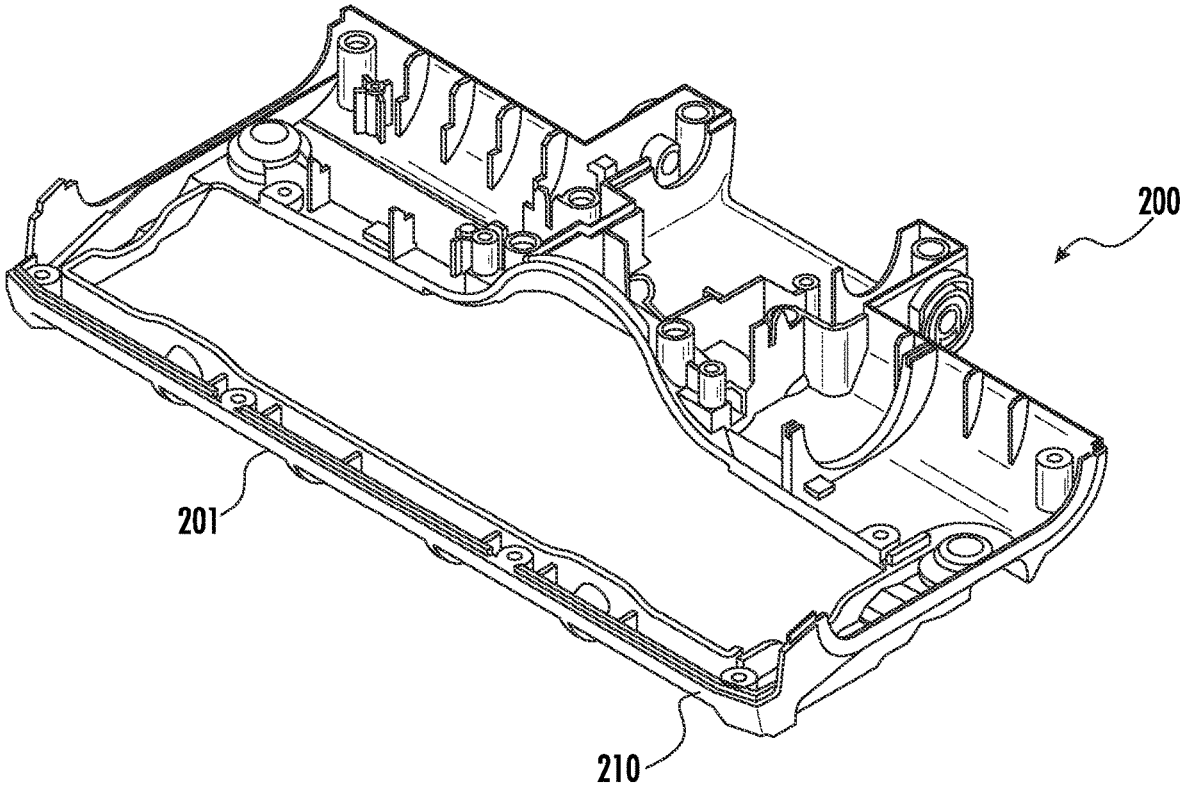
FIG. 6A illustrates an isometric view of one embodiment of a bottom frame of a vacuum cleaner nozzle, consistent with embodiments of the present disclosure.
Figure 6B:
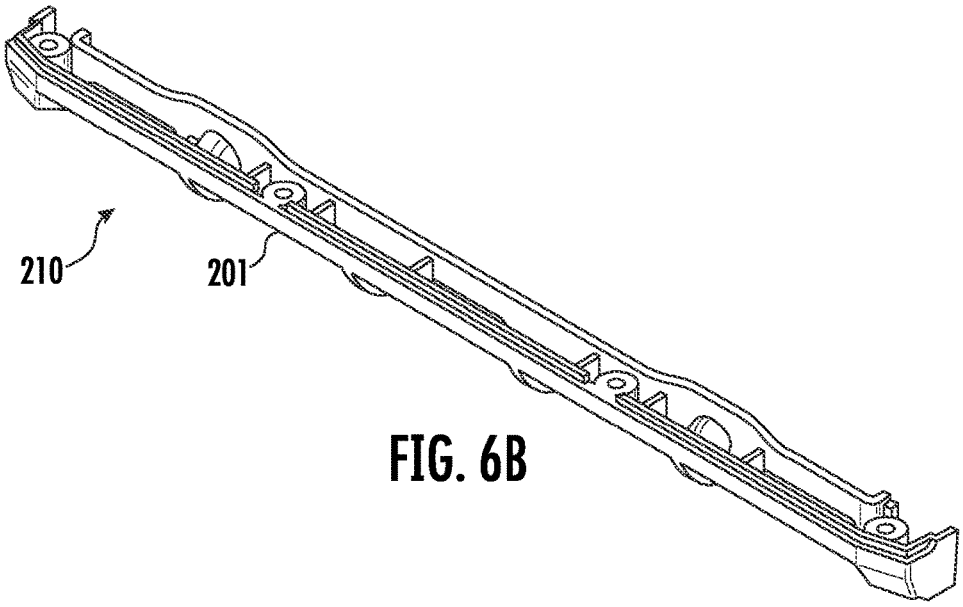
FIG. 6B illustrates an isometric view of the leading edge of the bottom frame of FIG. 6A, consistent with embodiments of the present disclosure.
Figure 7A:
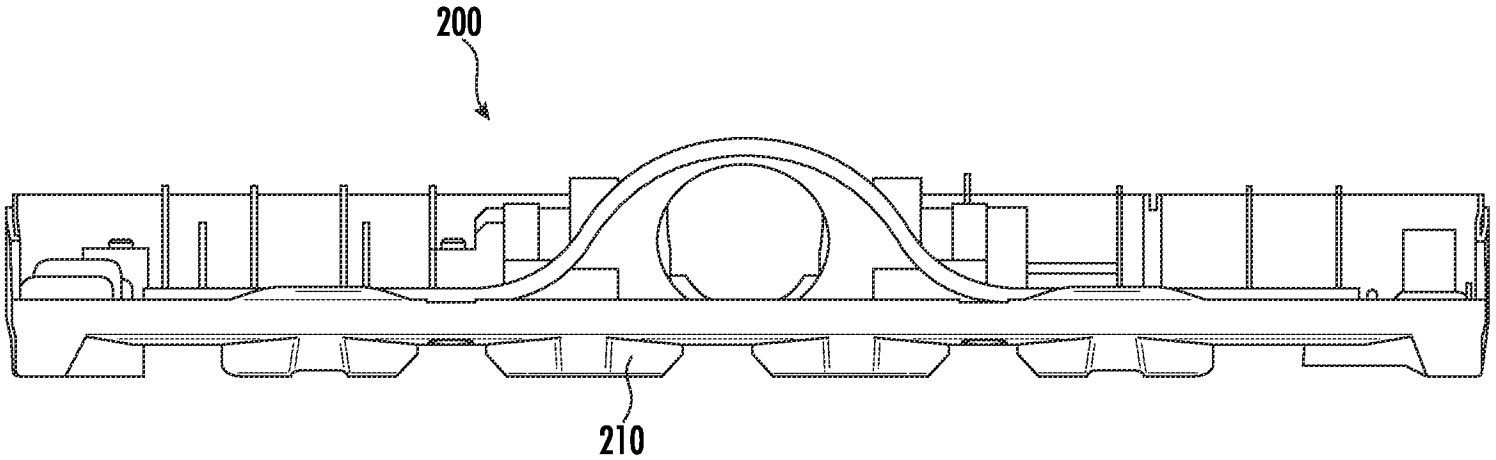
FIG. 7A illustrates a front view of the bottom frame of a vacuum cleaner nozzle of FIG. 6A, consistent with embodiments of the present disclosure.
Figure 7B:
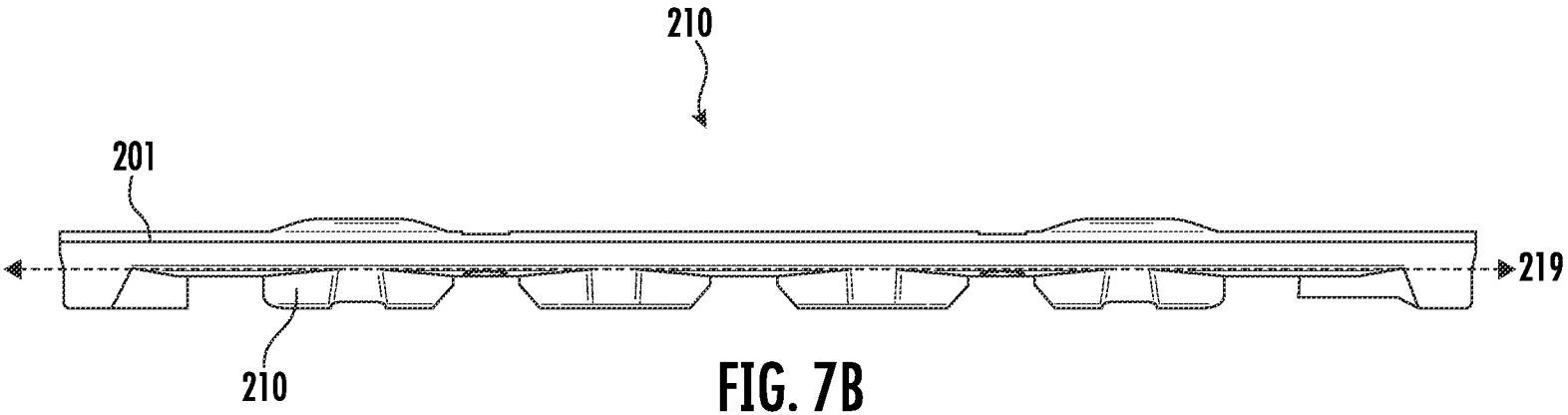
FIG. 7B illustrates a front view of the leading edge of the bottom frame of FIG. 7A, consistent with embodiments of the present disclosure.
Figure 8A:
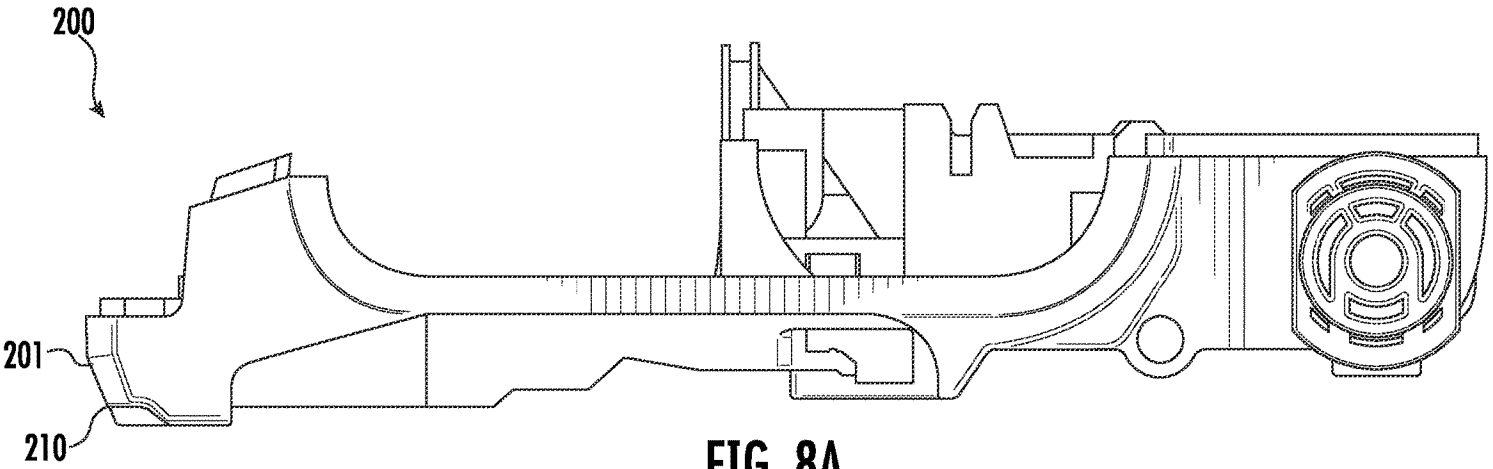
FIG. 8A illustrates a side view of the bottom frame of a vacuum cleaner nozzle of FIG. 6A, consistent with embodiments of the present disclosure.
Figure 8B:
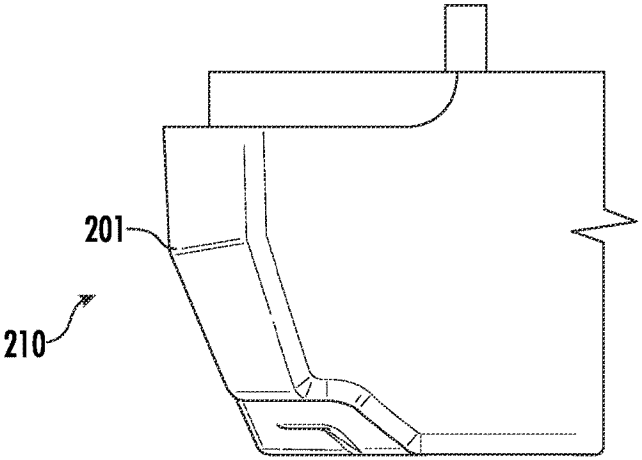
FIG. 8B illustrates a side view of the leading edge of the bottom frame of FIG. 8A, consistent with embodiments of the present disclosure.
Figure 9A:
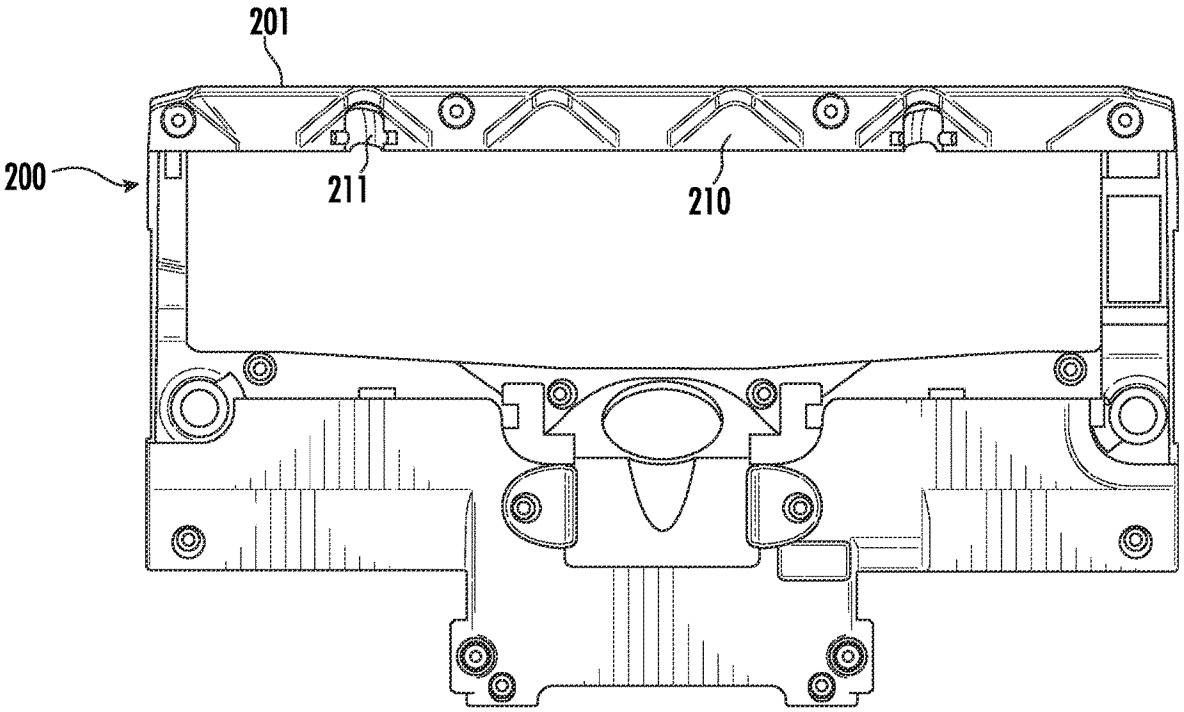
FIG. 9A illustrates a bottom view of the bottom frame of a vacuum cleaner nozzle of FIG. 6A, consistent with embodiments of the present disclosure.
Figure 9B:
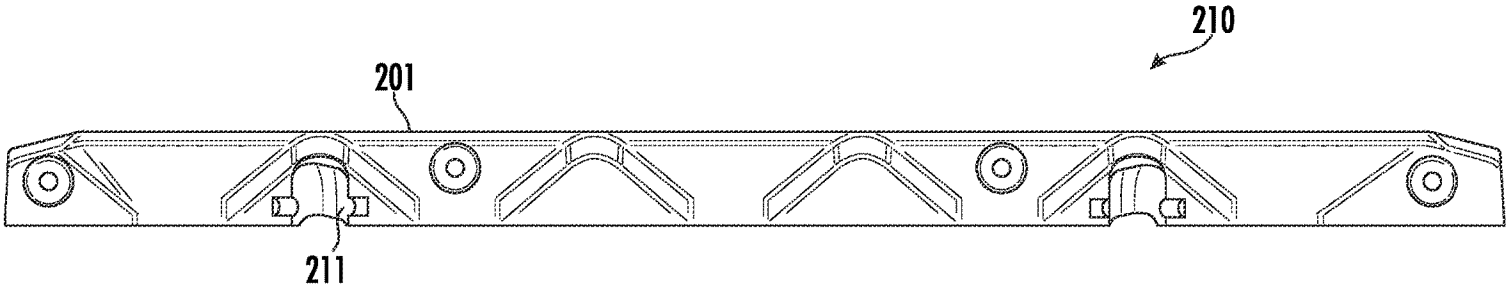
FIG. 9B illustrates a bottom view of the leading edge of the bottom frame of FIG. 9A, consistent with embodiments of the present disclosure.
Figure 10:
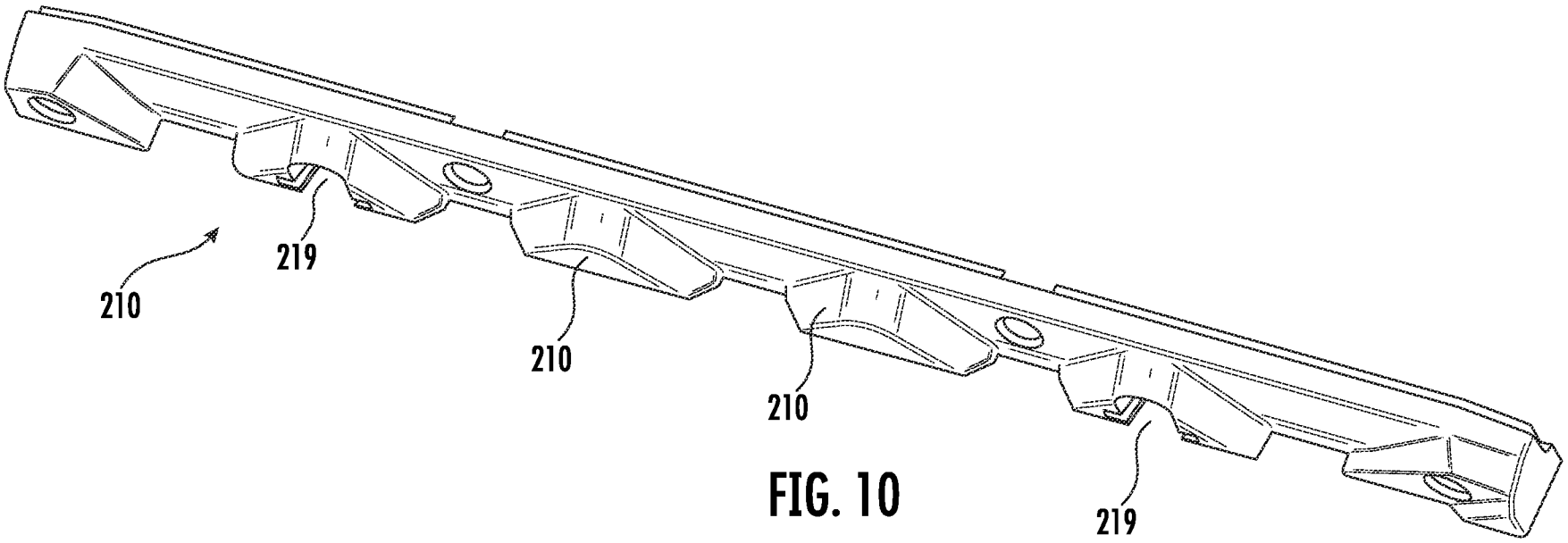
FIG. 10 illustrates an isometric view of the leading edge of the bottom frame of FIG. 9A, consistent with embodiments of the present disclosure.

With this in mind, FIG. 1 generally illustrates an isometric view of a nozzle 100. FIG. 2 generally illustrates a front view of a nozzle 100 of FIG. 1. FIG. 3 generally illustrates a side view of the nozzle 100 of FIG. 1. FIG. 4 generally illustrates a bottom view of the nozzle 100 of FIG. 1. FIG. 5 generally illustrates a bottom perspective view of the nozzle 100 of FIG. 1.

It should be understood that the nozzle 100 shown in FIGS. 1-5 is for exemplary purposes only and that a vacuum cleaner consistent with the present disclosure may not include all of the features shown in FIGS. 1-5, and/or may include additional features not shown in FIGS. 1-5. Again, without limitations, a nozzle consistent with the present disclosure may be incorporated into a robot vacuum cleaner.

As shown, the nozzle 100 may include a body or housing 130 that at least partially defines/includes one or more agitator chambers 122. The agitator chambers 122 include one or more openings (or dirty air inlets) 123 (e.g., as shown in FIGS. 4-5) defined within and/or by a portion of the bottom surface/plate 105 of the housing 130. At least one rotating agitator or brush roll 180 is configured to be coupled to the nozzle 100 (either permanently or removably coupled thereto) and is configured to be rotated about a pivot axis within the agitator chambers 122 by one or more rotation systems (not shown for clarity). In some instances, the brush roll 180 may at least partially extending through the dirty air inlet 123. The rotation systems may be at least partially disposed in the nozzle 100, and include one or more motors, e.g., AC and/or DC motors, coupled to one or more belts and/or gear trains for rotating the agitators 180.

The nozzle 100 may be coupled to a debris collection chamber (not shown) such that the same is in fluid communication with the agitator chamber 122 to draw in and store debris collected by the rotating agitator 180. The agitator chamber 122 and debris chamber fluidly couple to a vacuum source (e.g., a suction motor or the like) for generating an airflow (e.g., partial vacuum) in the agitator chamber 122, the dirty air inlet 123, and debris collection chamber to thereby suck up debris proximate to the agitator chamber 122, the dirty air inlet 123, and/or the agitator 180.

Rotation of the agitator 180 operates to agitate/loosen debris from the cleaning surface. Optionally, one or more filters disposed within the nozzle 100 (or other suitable location of a vacuum) remove ultra-fine debris (e.g., dust particles or the like) entrained in the vacuum air flow.

One or more of the debris chamber, vacuum source, and/or filters may be at least partially located in the nozzle 100. Additionally, one or more suction tubes, ducts, or the like 136 may be provided to fluidly couple the debris chamber, vacuum source, and/or filters to the nozzle 100. The nozzle 100 may include and/or may be configured to be electrically coupled to one or more power sources such as, but not limited to, an electrical cord/plug, batteries (e.g., rechargeable, and/or non-rechargeable batteries), and/or circuitry (e.g., AC/DC converters, voltage regulators, step-up/down transformers, or the like) to provide electrical power to various components of the nozzle 100 such as, but not limited to, the rotation systems and/or the vacuum source.

The housing 130 may further include a top surface 102 and a front (or leading) edge 101. Air may generally flow past the front edge 101, through the dirty air inlet 123, and into the agitator chamber 122. A plurality of castellations 110 may be provided in front of the agitator chamber 122 (e.g., in front of the dirty air inlet 123). In some instances, the plurality of castellations 110 may be provided along at least a portion of (e.g., all) of the front edge 101 of the nozzle 100. The castellations 110 may be spaced apart such that the spacing between the castellations 110 defines, at least in part, one or more (e.g., a plurality) of castellation inlets and associated castellation inlet paths which transition to a shared suction channel within the nozzle 100.

As shown more clearly in FIGS. 4-5, each of the castellations 110 may be defined by two or more sidewalls or projections 114 that extend away from the plate 105 of the housing 130 such that the castellations 110 have an arcuate profile (e.g., but not limited to, a substantially triangular profile, arrow-head profile, V-shaped profile, and/or U-shaped profile). In some instances, the sidewalls 114 may taper towards the front edge 101 of the nozzle 100 to define an apex, inflection point, and/or tip 115. The apex, inflection point, and/or tip 115 may be disposed closer to the front edge 101 of the nozzle 100 than an opposing base or rear end 117 of the sidewalls 114. The opposing base or rear end 117 of the sidewalls 114 may be defined as the portion of the castellation 110 that is closest to the dirty air inlet 123.

In some instances, each castellation 110 may be defined, at least in part, by two sloping/angled edges or sidewalls 114 that extend from the ends 117 (e.g., proximate to dirty air inlet 123 of the nozzle 100) the towards each other and substantially transverse relative to the front edge 101, such that the two sloping/angled edges or sidewalls 114 meet at an apex, inflection point, and/or tip 115 (which may be proximate and/or adjacent to the front edge 101). Put another way, the distance between the two sidewalls 114 decreases from the rear of the castellation 110 (i.e., the portion of the castellation 110 closest to the dirty air inlet 123) towards the front of the castellation 110 (i.e., the apex, inflection point, and/or tip 115 that is closest to the front edge 101 of the nozzle 100). The apex, inflection point, and/or tip 115 of the castellation 110 is therefore furthest from the dirty air inlet 123.

Adjacent castellations 110 collectively define a tapered castellation air inlet 103. In some instances, the castellation air inlet 103 may taper from the front of the nozzle 100 (e.g., the front edge 101) and/or from the apex, inflection point, and/or tip 115 towards the dirty air inlet 123 of the nozzle 100 and/or towards the ends 117. Each castellation air inlet 103 may include a tapered profile having a first width W1 (as shown in FIG. 4) proximate and/or adjacent to the front (e.g., the front edge 101) of the nozzle 100 that transitions to a second width W2 proximate and/or adjacent to the dirty air inlet 123 of the nozzle 100. Alternatively (or in addition), each castellation air inlet 103 may include a tapered profile having a first width W1 between the apex, inflection point, and/or tip 115 of the adjacent castellations 110 that transitions to a second width W2 between the ends 117 of the adjacent castellations 110. It should be appreciated that the first width W1 is greater than the second width W2. The taper of the castellation air inlet 103 may generally inversely correspond to the taper of the adjacent castellations 110. As discussed further below, the distance between adjacent castellations 110 and castellation characteristics (such as dimensions and surface angles) can be selected to achieve a desired air flow/suction and clearance profile for target debris, e.g., CHEERIOS™.

Continuing on, the castellations 110 may be provided adjacent and/or proximate to and along at least a portion of the front edge 101 of the nozzle 100 to allow debris to pass through the front edge 101, through the castellation air inlets 103, to the dirty air inlet 123 of the nozzle 100, and ultimately, into the main body during use of the surface treatment apparatus. As further shown in FIGS. 4-5, one or more of the castellations 110 can provide projections with wheel receptacles/cavities 119. Wheels, e.g., wheels 111, may be disposed at least partially within (e.g., coupled to) the wheel receptacles 119 and confined therein. The wheels 111 (and associated receptacles 119) provided by the castellations 110 advantageously allow for the wheels 111 to be disposed at a position within the nozzle 100 that is offset away from the lateral sides 121 of the nozzle 100 (e.g., the left and right sides), e.g., to allow for improved edge cleaning as discussed above. Moreover, placement of the wheels 111 within the wheel receptacles 119 of the castellations 110 minimizes or otherwise reduces the potential for restricting air flow.

FIGS. 6A-11B illustrate an example embodiment of a bottom frame 200 of a nozzle consistent with embodiments of the present disclosure. The bottom frame 200 includes a plurality of castellations 210. The castellations 210 are arranged at and/or proximate to the leading edge 201 of the bottom frame 200 and protrude from a lower plane 219 (e.g., of the bottom frame 200) towards a floor surface. As discussed above, one or more of the castellations 210 can define a wheel receptacle 219 (best seen in FIGS. 10 and 11A) to receive and couple to, for instance, wheel 211 (e.g., best seen in FIGS. 9A and 9B).

Figure 11A:
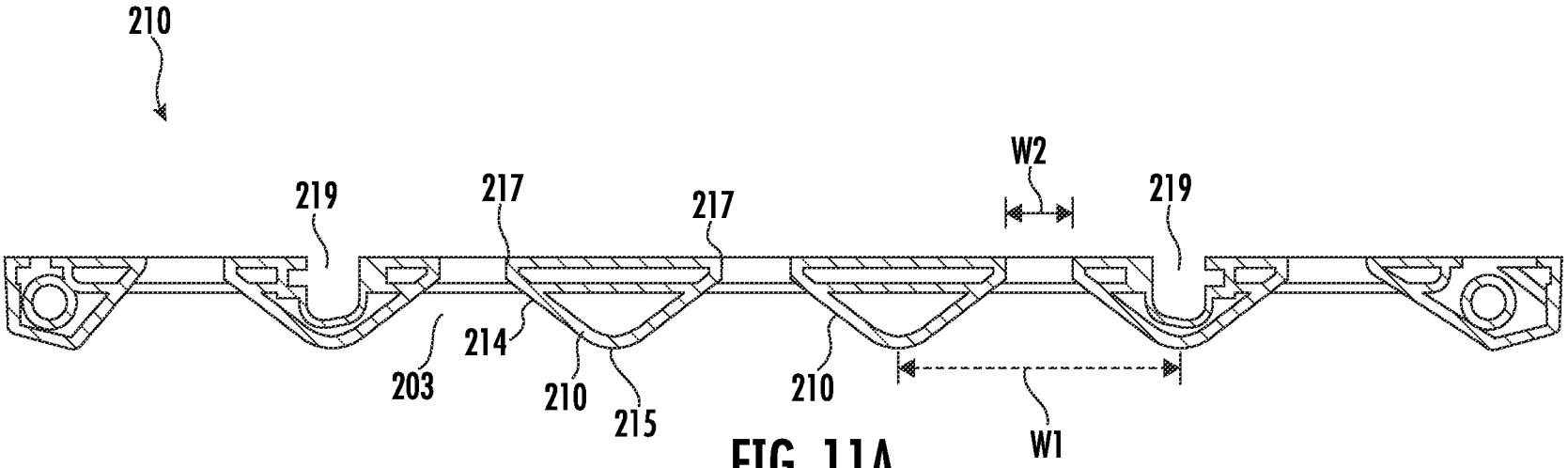
FIGS. 11A-11B illustrate cross-sectional views of one embodiment of the leading edge of the bottom frame of FIG. 6A take along line 219 of FIG. 7B, consistent with embodiments of the present disclosure.
Figure 11B:
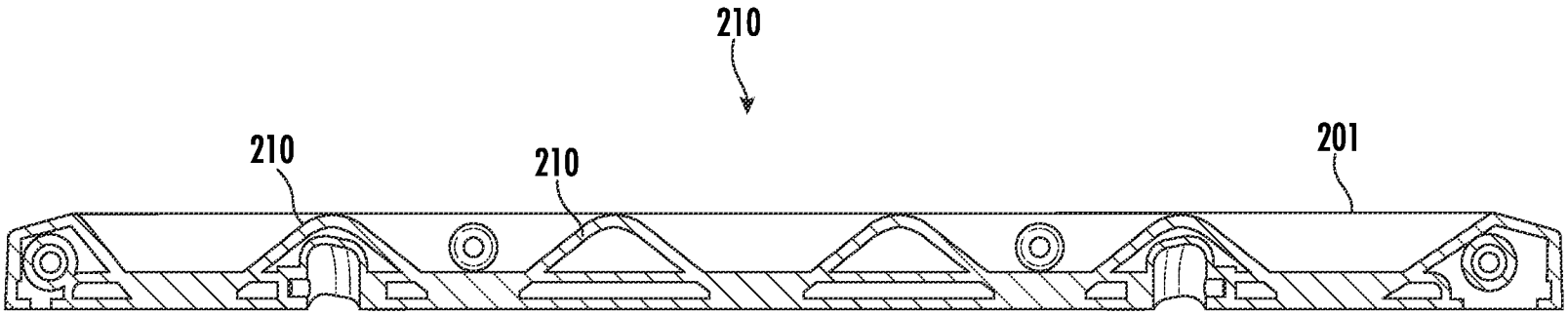

As best in FIG. 11A, each of the castellations 210 may be defined by one or more sidewalls or projections 214 that extend away from the lower plane 219 of the bottom frame 200 such that the castellations 210 have an arcuate profile (e.g., but not limited to, a substantially triangular profile, arrow-head profile, V-shaped profile, and/or U-shaped profile). In some instances, the sidewalls 214 may taper towards the front edge 201 of the nozzle to define an apex, inflection point, and/or tip 215. The apex, inflection point, and/or tip 215 may be disposed closer to the front edge 201 of the nozzle than an opposing base or opposite end 217 of the sidewalls 214 (e.g., closer to the front of the nozzle than the rear of the nozzle).

Adjacent castellations 210 collectively define a tapered castellation air inlet 203. In some instances, the castellation air inlet 203 may taper from the front of the nozzle (e.g., the front edge 201) towards the dirty air inlet of the nozzle. Alternatively (or in addition), the castellation air inlet 203 may taper from the from the apex, inflection point, and/or tip 215 towards the ends 217. Each castellation air inlet 203 may include a tapered profile having a first width W1 proximate and/or adjacent to the front (e.g., the front edge 201) of the nozzle that transitions to a second width W2 proximate and/or adjacent to the dirty air inlet of the nozzle. Alternatively (or in addition), each castellation air inlet 203 may include a tapered profile having a first width W1 between the apex, inflection point, and/or tip 215 of the adjacent castellations 210 that transitions to a second width W2 between the ends 217 of the adjacent castellations 210. In any event, the first width W1 is greater than the second width W2. The taper of the castellation air inlet 203 may generally inversely correspond to the taper of the sidewalls 214 of adjacent castellations 210.

The present disclosure has identified that multiple factors of the castellations 210 function in combination and can be selected to achieve a desired function and air flow/suction.

FIGS. 12-15 show example dimensions of a castellation 1100 consistent with embodiments of the present disclosure. One aim of the present disclosure is to balance the need to maximize air flow/suction with the ability to allow relatively large debris to enter the nozzle between the castellations 1100 (e.g., through the tapered castellation air inlets). With this in mind, the present disclosure has identified that spacing (or the offset distance) between the adjacent castellations 1100 determines, at least in part, the overall size/dimensions of debris that can enter into the brush roll chamber (e.g., through the castellation air inlets). Preferably, the spacing between adjacent castellations 1100 is set to a predefined uniform offset distance that allows for objects about the size of CHEERIOS™ to pass between the adjacent castellations 1100 and through the castellation air inlets.

Continuing on, castellations 1100 protrude from a face 1104 of the nozzle that is closest to the floor during operation. Each castellation 1100 has a bottom surface 1105 that is in contact or adjacent with a floor surface during operation. The overall height 1103 of the castellation 1100 is the distance from the face 1104 of the nozzle to the bottom surface 1105 of the castellation 1100. Castellation height 1103 is partially determined based on the ground clearance desired for a nozzle. Ground clearance further impacts the maximum size of debris that can pass underneath the castellation 1100 and can affect transitions over thresholds, for example.

The horizontal dimension or castellation width 1107 of any individual castellation 1100 is one factor that determines how much area the castellation will restrict. Castellation width 1107 can be determined based on, for instance, the opening width of the nozzle inlet and the spacing between each castellation 1100. Increasing the castellation width 1107 (e.g., resulting in wider castellations 1100) generally increases the surface area coverage of a nozzle for a given number of castellations 1100 and a given nozzle width. The surface area coverage of the nozzle caused by the increased width 1107 of the castellations 1100 creates narrower openings in the nozzle inlet (i.e., narrower castellation air inlets). These narrower openings/castellation air inlets cause higher air velocity through the nozzle during operation.

Castellation depth 1108 is the dimension of how far back the castellation 1100 extends from the front edge of the nozzle towards the brush roll chamber. Put another way, the castellation depth 1108 is the dimension of how far back the castellation 1100 extends from the apex, inflection point, and/or tip towards the dirty air inlet of the nozzle.

The angle of the front "hull" of the castellation 1100 or Hull Angle (ϕ) 1110 (FIG. 14) is the angle that the front of the castellation 1100 makes between its two edges or sidewalls 1014. The hull angle 1110 affects how fast large debris will be able to slide through the castellation air inlets and into the brush roll chamber after contact with the castellation 1100. With a smaller angle 1110, a castellation 1100 generally mimics a flat blade, and the large debris can readily pass by and/or through the leading edge 1112 of the nozzle and into the brush roll chamber. However, a larger angle 1110 usually means the large debris will face more resistance when entering the castellation air inlets and brush roll chamber. Generally, a larger hull angle 1110 leads to more large debris accumulating and clogging the castellation air inlets and/or front inlet. Smaller hull angles 1110 may not be practical or as desirable on castellations 1100 with larger widths 1107.

Figure 16A:
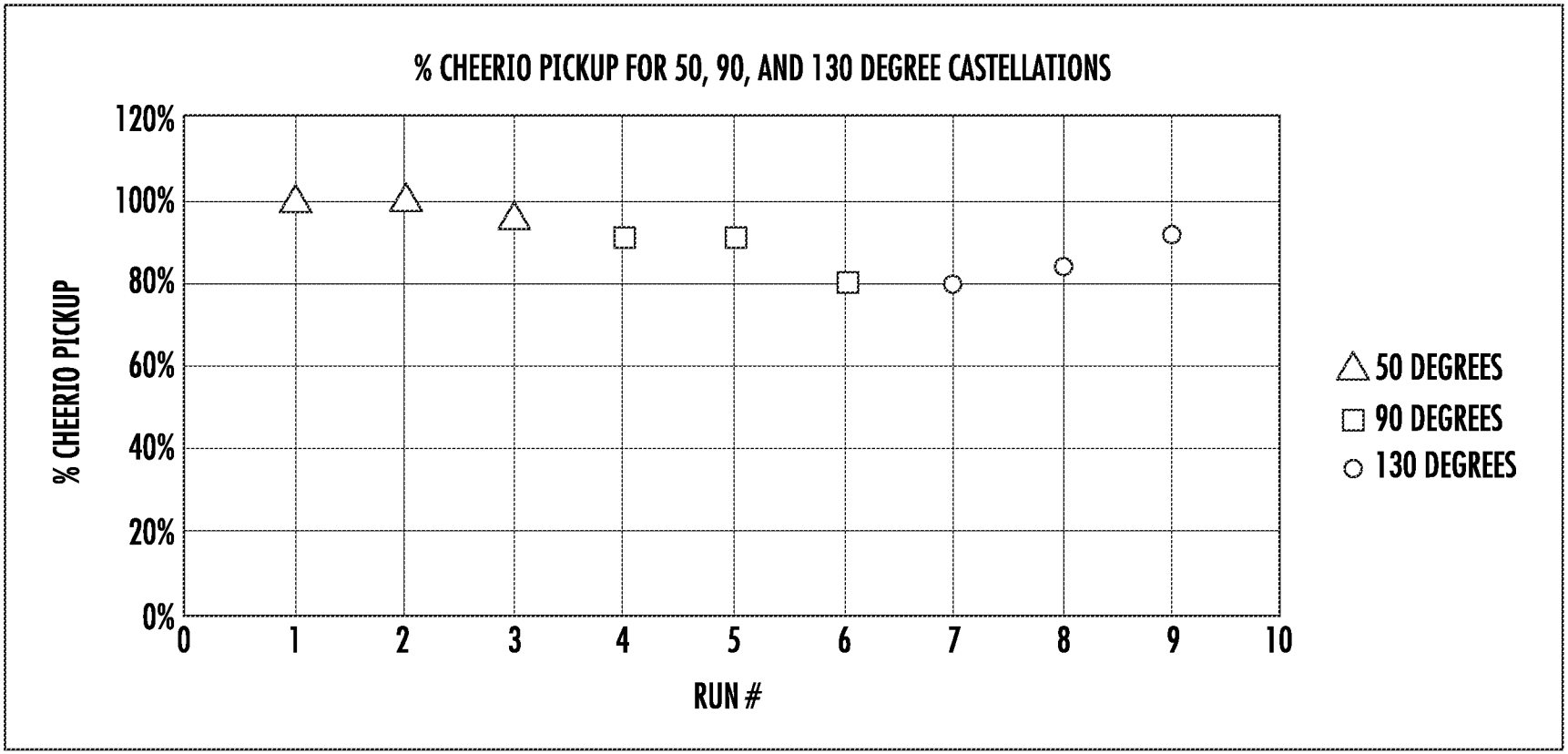
FIG. 16A is a graph illustrating large debris pickup with castellations of various hull angles.

As shown in FIG. 16A, larger hull angles may be acceptable when castellation width is large because the higher air velocity assists in evacuating large debris off of the ramp faster, which prevents or reduces the potential for clogging.

Assuming no suction or rolling motion of a CHEERIO™ when sliding down a castellation, its acceleration down the castellation (e.g., through the castellation air inlets) can be approximated as:

$$a \approx \frac{F_{app}}{m}\left[\sin\left(90-\frac{\phi}{2}\right)-\mu\cos\left(90-\frac{\phi}{2}\right)\right] \quad \text{Equation (1)}$$

Where $F_{app}$ is the force applied by the vacuum on the CHEERIO™.

Figure 16B:
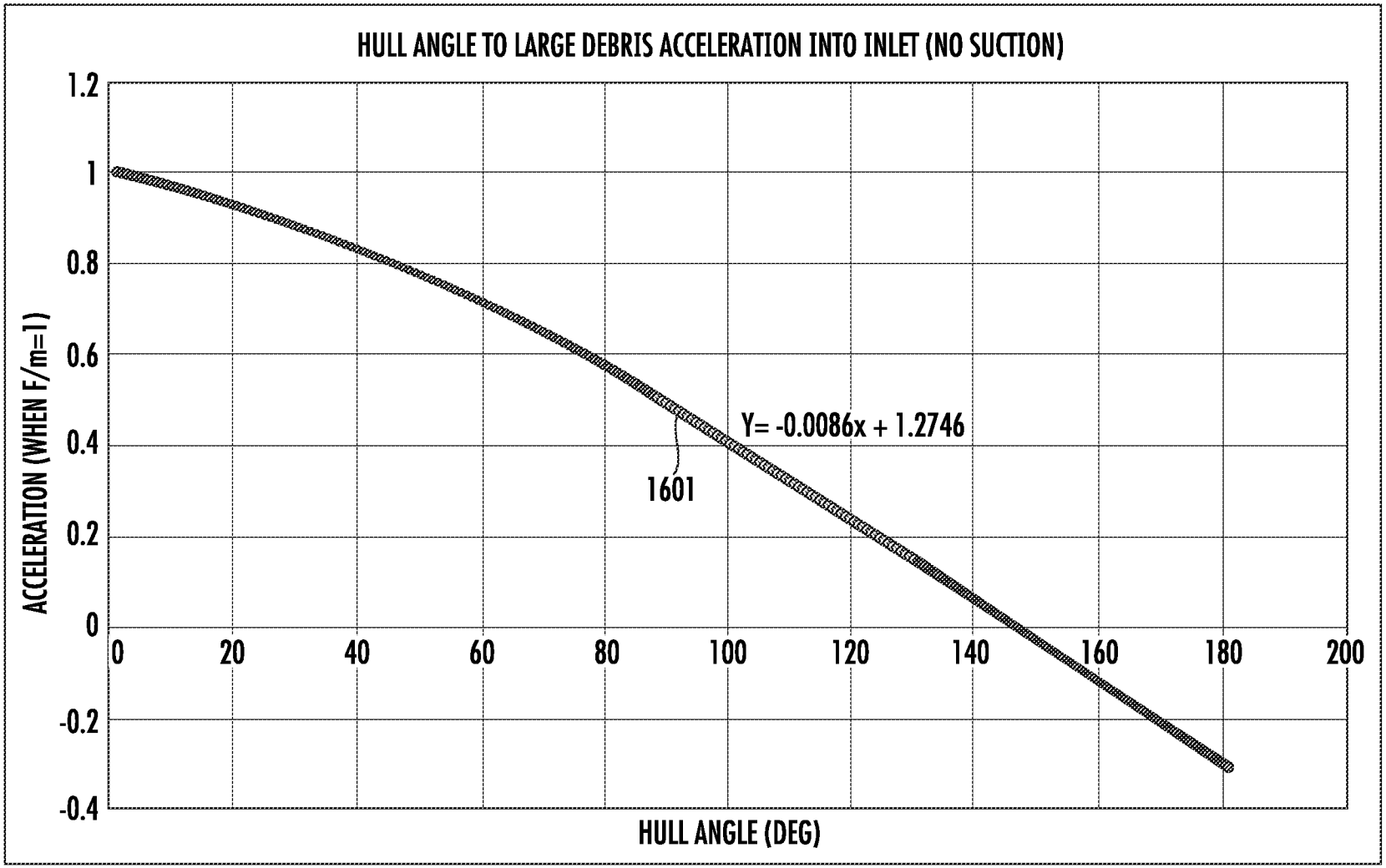
FIG. 16B is a graph illustrating the relationship between hull angle and debris acceleration in a suction nozzle with castellations.

FIG. 16B illustrates the relationship between hull angle and acceleration of the exemplar large debris. The lighter region 1601 of the line (between 90 and 130 degrees) represents the usual range of hull angles when modelling castellations. In this region 1601, acceleration decreases on average 2.8% for each hull angle degree increase, decreasing more per degree as the hull angle gets higher. Lower acceleration CHEERIO™ evacuate into the brush roll chamber slower, leading to more clogs and failures in picking up debris.

Figure 12:
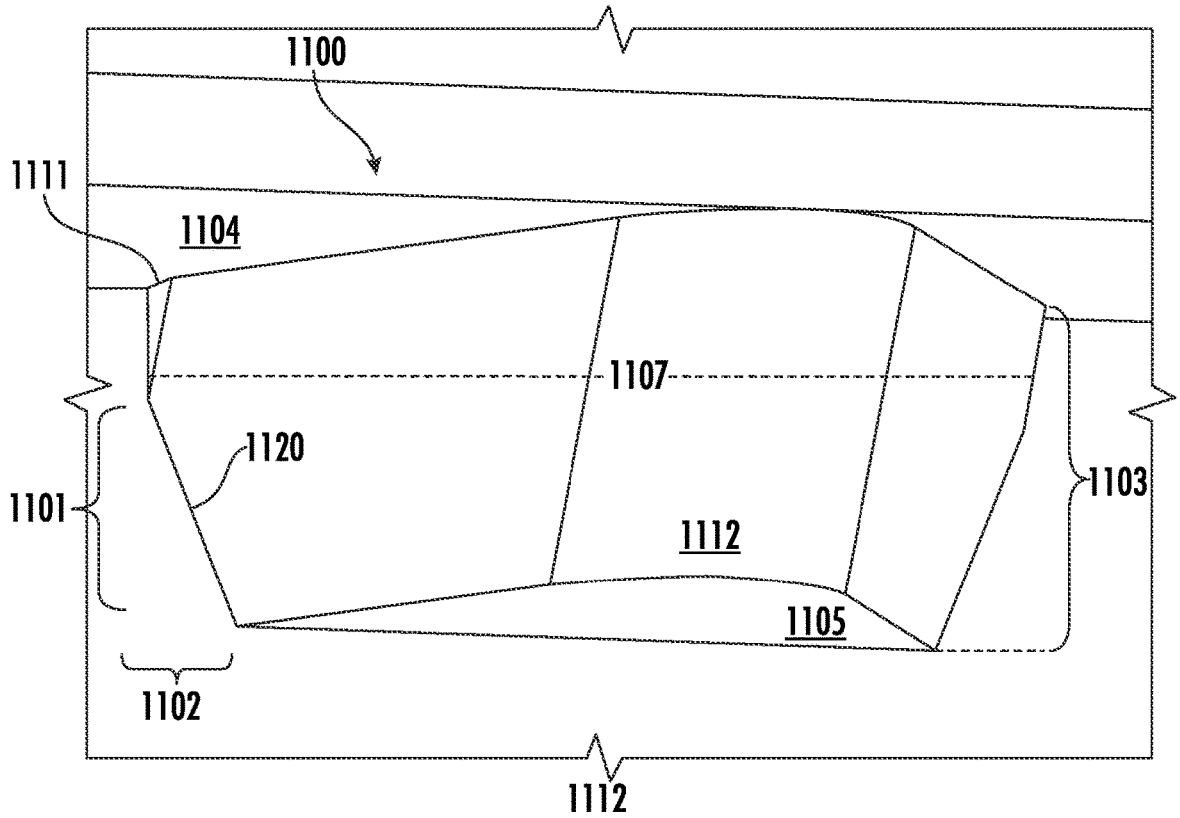
FIG. 12 illustrates a front perspective view of one embodiment of a castellation, consistent with embodiments of the present disclosure.
Figure 13:
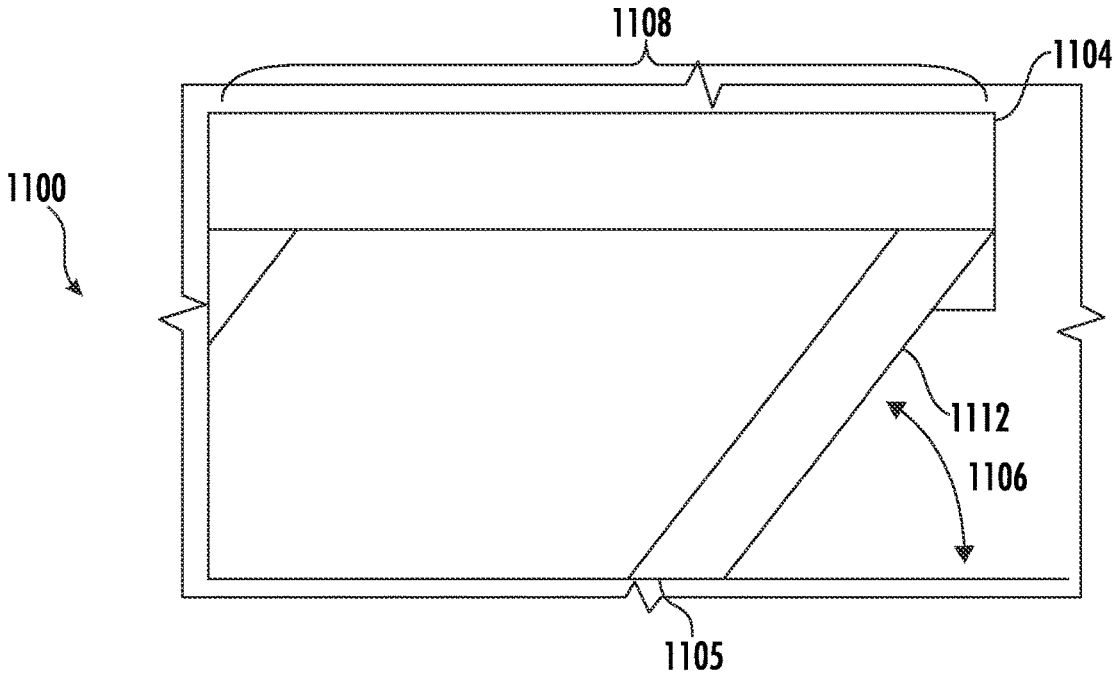
FIG. 13 illustrates a side view of one embodiment of a castellation, consistent with embodiments of the present disclosure.
Figure 14:
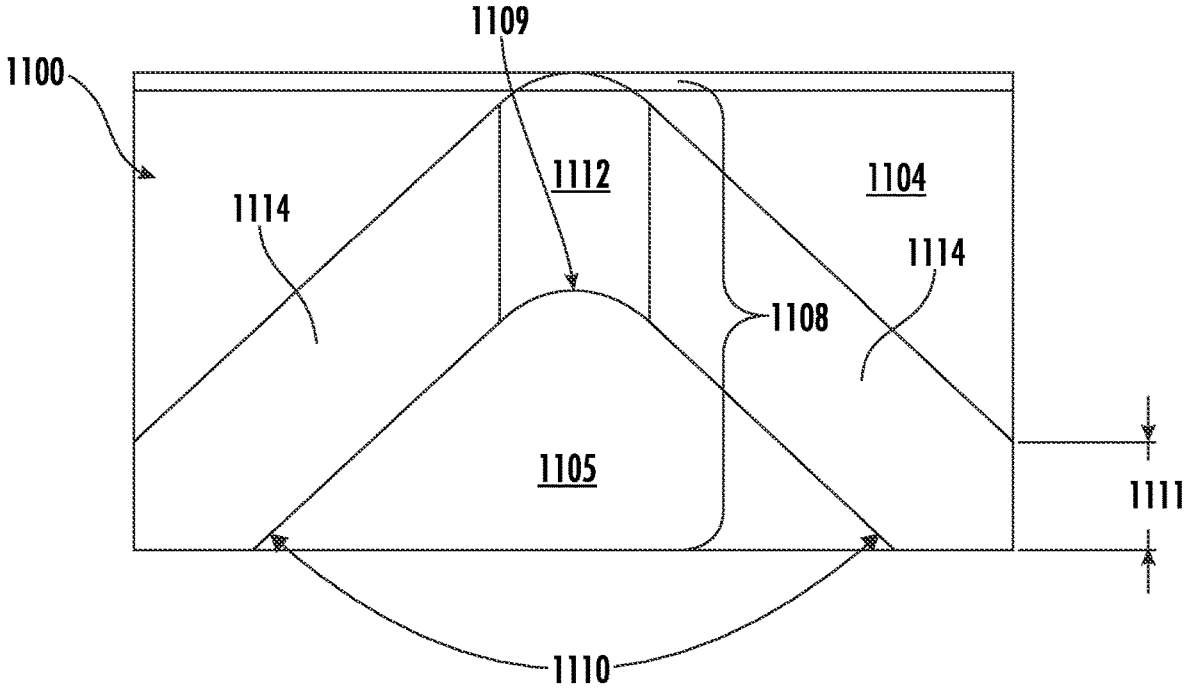
FIG. 14 illustrates a bottom perspective view of one embodiment of a castellation, consistent with embodiments of the present disclosure.
Figure 15:
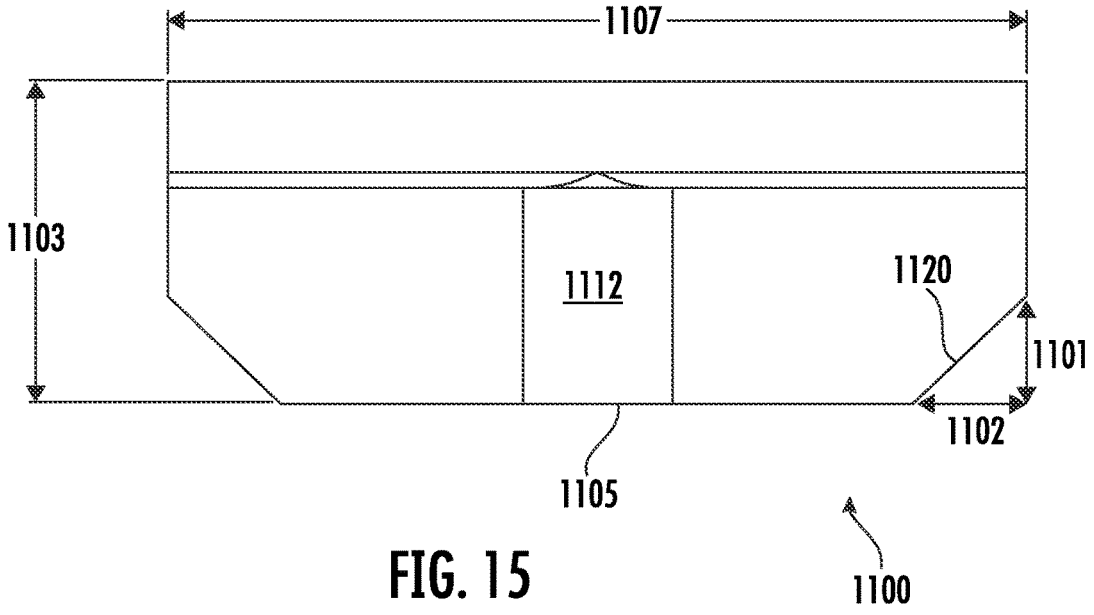
FIG. 15 illustrates a front view of one embodiment of a castellation, consistent with embodiments of the present disclosure.

In the present disclosure, the castellations 1100 are further characterized by at least one chamfer 1120 (FIG. 12). Chamfers 1120 can be created/formed by removing a portion of the castellation 1100, and its dimensions are then chosen to achieve nominal suction and clearance as discussed above. It should also be appreciated that the chamfers 1120 may be created/formed initially without the portion. For example, the chamfers 1120 may be created/formed by creating/forming (e.g., but not limited to, molding) the castellations 1100 with the geometry described herein such that no portion of the castellations 1100 is removed. The chamfers 1120 may be used with or without the tapered or arcuate profile described above.

Chamfers 1120 may be formed through beveled edges and/or surfaces in one or more sidewalls 1214 of the castellations 1100 (e.g., one or more otherwise perpendicular faces). In at least one example, the chamfer 1120 is disposed only in the bottom portion of the castellations 1100 (i.e., the top portion of the castellations 1100 may be generally normal or perpendicular to the surface to be cleaned); however, it should be appreciated that the entire sidewall 1214 (e.g., the top and the bottom portions) may include the chamfer 1120. The bottom portion of the castellations 1100 is defined as the portion of the castellations 1100 that is closest to the surface to be cleaned, while the top portion of the castellations 1100 is defined as the portion of the castellations 1100 that is furthest from the surface to be cleaned.

The chamfer 1120 may extend around the entire bottom periphery or region of the castellations 1100 (e.g., around all of the sidewalls 1214 of the castellations 1100) or around only a portion of the bottom periphery or region of the castellations 1100 (e.g., around only a portion of the bottom periphery of one or more of the sidewalls 1214 of the castellations 1100). The chamfer 1120 may be the same along the entire bottom periphery or region of the castellations 1100 or may vary along the length of the bottom periphery or region.

As seen in FIG. 12, chamfers 1120 that are flush with the back of the castellation 1100 generally widen the spacing at the bottom 1105 while keeping the spacing tighter (i.e., smaller) at the top 1104. This increases the overall surface area restricted by the castellation 1100 and increases air velocity, while importantly still allowing passage of larger debris. Put another way, the chamfer 1120 may include a portion of one or more of the sidewalls 1214 of the castellation 1100 which is not perpendicular or normal to the surface to be cleaned (e.g., the floor). The chamfer 1120 may therefore be thought of as having a vertically increasing taper such the castellation width 1107 proximate the top 1104 of the castellation 1100 is larger than the castellation width 1107 proximate to the bottom surface 1105 of the castellation 1100. The chamfer 1120 may be planar (as generally illustrated) and/or may have a curved profile.

It should be appreciated that the castellation air inlets defined between adjacent castellations 1100 may also have a profile that generally inversely corresponds to the chamfer 1120 of the adjacent castellations 1100. For example, the castellation air inlets may therefore be thought of as having a vertically decreasing taper such the castellation air inlet width proximate the top 1104 of the adjacent castellations 1100 is smaller than the castellation air inlet width proximate to the bottom surface 1105 of the adjacent castellations 1100. As such, adjacent castellations 1100 with chamfers 1120 may be considered to at least partially define chamfered castellation air inlets.

The primary dimensions of the chamfer 1120 are its horizontal (x) 1102 and vertical (y) 1101 dimensions. These dimensions 1102, 1101 help determine the size and type of debris that can get through the castellation air inlets and to the brush roll chamber.

As stated above, the dimensions of the castellation 1100 affect the possible dimensions 1102, 1101 of any potential chamfer 1120.

Extrusion Angle (a) 1106 (FIG. 13) is the angle that the castellation 1100 makes with respect to the horizontal (side view). The extrusion angle 1106 affects both the x and the y component of the chamfer 1120.

Radius (R) 1109 (FIG. 14) is the radius of the front fillet on the castellation 1100 (i.e., the apex, inflection point, and/or tip), and affects primarily the x component of the chamfer 1120. The radius 1109 affects primarily the x component of the chamfer 1120.

Castellation height 1103 (FIGS. 12 and 15) affects both the x and the y component of the chamfer 1120.

Castellation width 1107 (FIG. 12) affects primarily x component of the chamfer 1120.

Castellation depth 1108 (FIG. 14) affects primarily the x component of the chamfer 1120.

Hull angle 1110 (FIG. 14) affects primarily the x component of the chamfer 1120.

Offset (O) 1111 (FIGS. 12 and 14) is the distance that the angled walls 1114 of the castellation 1100 are shifted towards the front of the plate.

With standard castellations, the determination of the spacing between castellations is straightforward and can be based on factors such as the size of the debris that needs to pass through a suction nozzle.

For instance, if a maximum dimension of a debris to be picked up, is 13.95 mm, then in a non-chamfered castellations, a minimum spacing of about 13.95 mm is required. Moreover, testing suggests that an additional 2 mm clearance reduces clogging at the intake nozzle. Testing and simulation has shown that additional clearance space does not further reduce clogging of debris at the nozzle and lowers air velocity through the nozzle (i.e., through the castellation air inlets). Therefore, spaces of 16 mm+−2 mm between each castellation allows passage of the target debris size through the castellation air inlets without clogging while also benefiting from the increased air velocity from castellations.

Figure 17A:
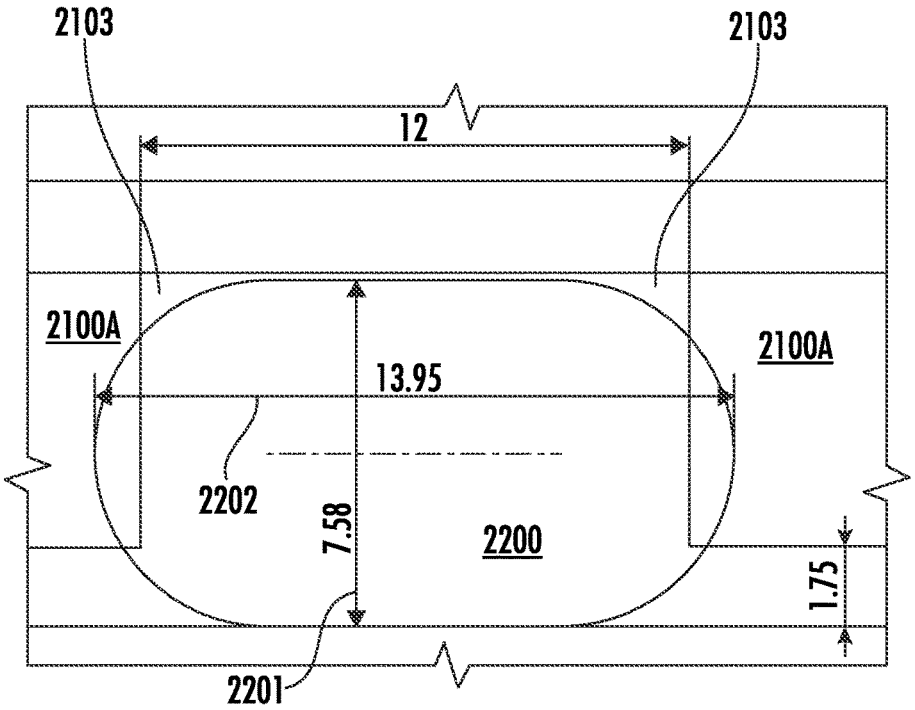
FIG. 17A and FIG. 17B are schematic front diagrams that illustrate nozzles with castellations as the nozzles encounter large debris, consistent with embodiments of the present disclosure.
Figure 17B:
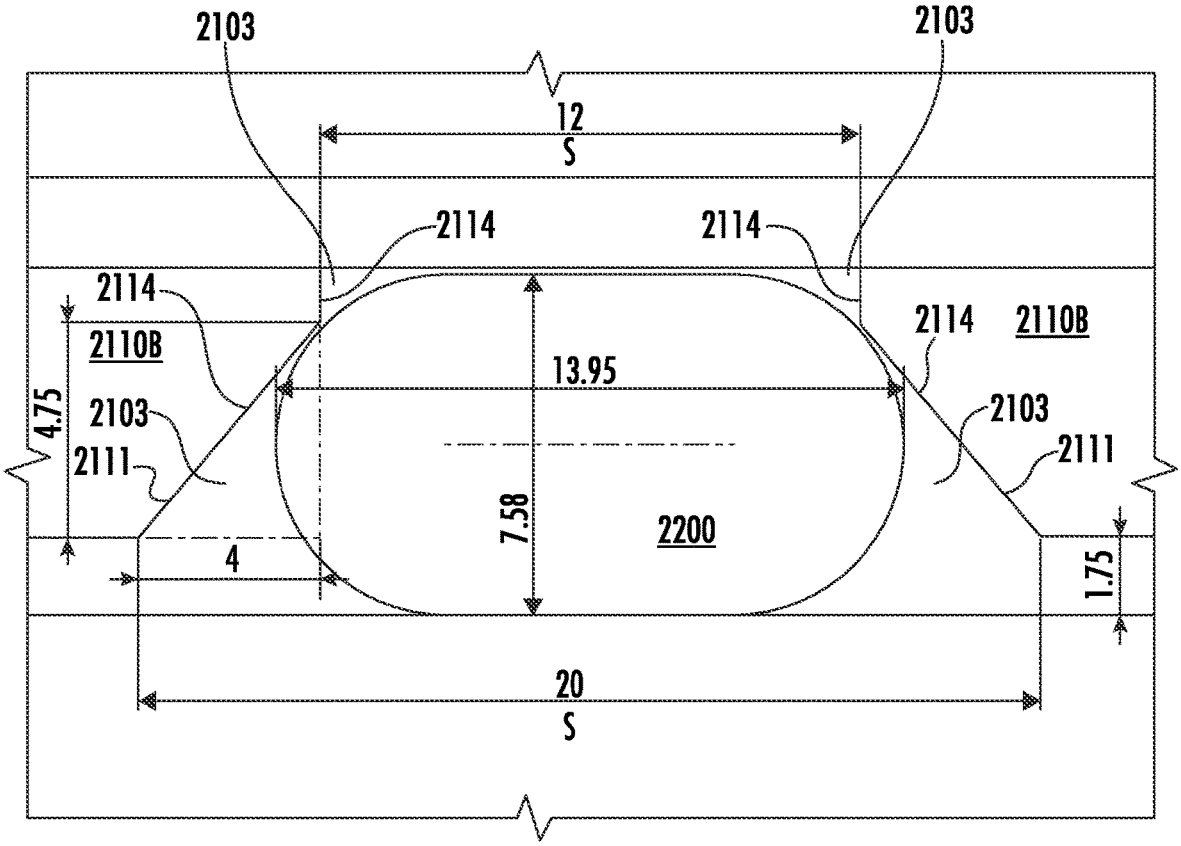

FIG. 17A and FIG. 17B are schematic diagrams that illustrate nozzles with castellations as the nozzles encounter large debris. FIG. 17A illustrates an adjacent castellations 2100A without one or more chamfers. FIG. 17B illustrates adjacent castellations 2110 with chamfers 2111. Large debris 2200, for example a CHEERIO™, cannot pass through the castellation air inlets 2103 defined between the adjacent castellations 2100A shown in FIG. 17A, but a piece of debris with the same dimensions is able to pass through the castellation air inlets 2103 defined by the adjacent castellations 2110B of FIG. 17B because of the increased spacing provided by the chamfers 2111.

FIG. 17A shows castellations 2100A with no chamfer and spacing of 12 mm. The example large debris 2200 has a height 2201 of 7.58 mm and an outer diameter 2202 of 13.95 mm.

FIG. 17B shows castellations 2110B with 4 mm×4.75 mm chamfers 2111 with spacing S of 12 mm between the non-chamfered portions of the sidewalls 2114 of the castellations 2110B. The x dimension of the chamfer 2111 extends the spacing S to 20 mm at the bottom. However, the use of the chamfer 2111 retains 29 $mm^2$ of inlet area per space as opposed to no chamfers with 20 mm spacing. Thus, larger debris 2202 is picked up without the decrease in air velocity caused by castellations 2110B with 20 mm spacing. It should be appreciated that the dimension described herein are for exemplary purposes only unless specifically claimed as such.

Just as the size of debris 2200 to be picked up is used to determine spacing for a standard castellation (i.e., the castellation air inlets), the dimensions of debris (e.g., the height 2201 and the width 2202) of the debris 2200 can be used to determine the dimensional components of a chamfer 2111. In addition to the width 2202, the height 2201 of a piece of debris 2200 may be used to calculate the vertical component (e.g., y component) of the chamfer 2111 (i.e., a distance substantially perpendicular or normal to the surface to be cleaned such as the floor). After the desired height has been calculated, the following formula may be used to determine the initial y component of the chamfer 2111:

$$y = \text{height} - \text{ground clearance} \qquad \text{Equation (2)}$$

The y component of the chamfer 2111 may also generally correspond to the y component of the castellation air inlets.

The x component of the chamfer 2111 should be preferably selected such that it creates the desired spacing between adjacent castellations 2100 (e.g., the width of the castellation air inlets) without chamfers at the midpoint of the chamfer 2111. Thus, the initial desired spacing for castellations 2100B is located in the middle of the space/castellation air inlets. For example, as mentioned above, when determining spacing without chamfers, 16 mm spacing between adjacent castellations 2100 was used to pick up 100% of debris 2200 with an outer dimension of 13.95 mm. The w component of the chamfer 2111 may also generally correspond to the w component of the castellation air inlets (e.g., a distance between adjacent castellations 2100 and/or the width of the castellation air inlets that is generally perpendicular to the y component and generally parallel to the surface to be cleaned such as the floor).

Figure 18:
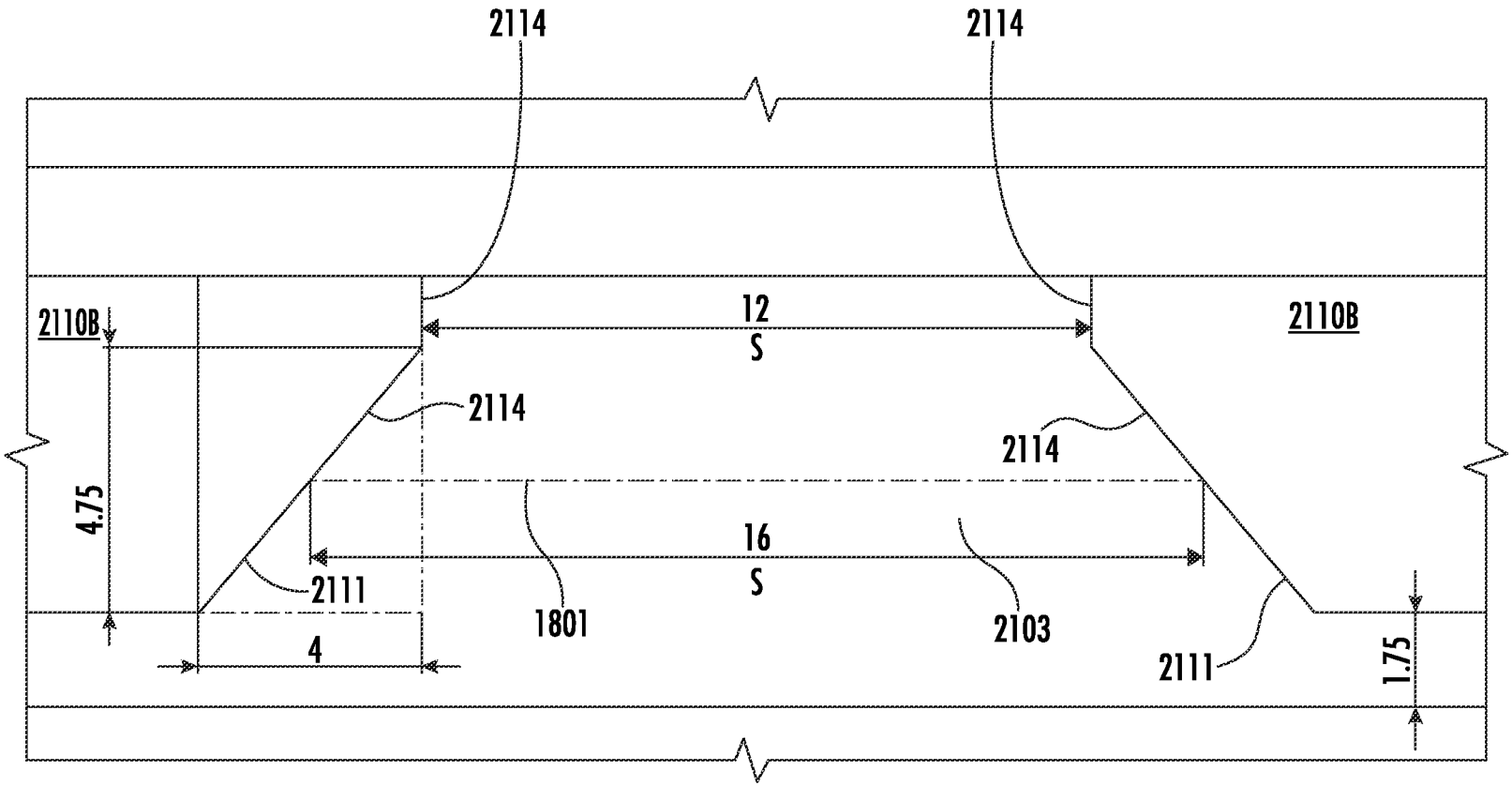
FIG. 18 illustrates a front view of one embodiment of a space between castellations, consistent with embodiments of the present disclosure.

As illustrated in FIG. 18, if a line 1801 is extended between the chamfers 2111 of two adjacent castellation 2011B at the midpoint of the chamfer's hypotenuse, this value may equal whatever nominal spacing was initially calculated without the use of a chamfer 2111 (e.g., the w component of the chamfer 2111). In the present embodiment, a 4 mm×4.75 mm chamfer 2111 is used on top of a 12 mm wide spacing to create a 16 mm space at the midpoint of the chamfer 2111. Again, it should be appreciated that these values are for exemplary purposes only, and the present disclosure is not limited to these values unless specifically claimed as such.

Once the requirements of a castellation 2110 for a suction nozzle are determined, the following dimensions can be determined:

Chamfer Dimensions: x and y

Castellation Height: H (usually determined based on the suction nozzle requirements)

Extrusion Angle: α (45° may be used for initial calculations, but can be increased or decreased to achieve a desired radius)

Castellation Depth: D (determined based on the suction nozzle requirements)

Castellation Width: W (determined from front inlet width, spacing, and number of castellations)

Using the above dimensions, the following measurements may be calculated for castellations: Offset (O), Extrusion Length (E), Hull Angle (ϕ), and Radius (R).

$$E = \frac{H}{\sin\alpha} \quad \text{Equation (3)}$$

$$\phi = 2 * \tan^{-1}\left(\frac{x(H-y)}{Oy}\right) \quad \text{Equation (4)}$$

$$R = \frac{\frac{W}{2} - \left[(D-O)\tan\frac{\phi}{2}\right]}{\tan\left(45 - \frac{\phi}{4}\right)} \quad \text{Equation (5)}$$

The calculated dimensions may be used to construct castellations 2110B that allow the targeted debris 2200 to pass through the castellation air inlets and into suction nozzle (e.g., the dirty air inlet). Further considerations including aesthetics and structural support may dictate additional castellations characteristics.

As seen in FIGS. 19A-19D, some embodiments further include one or more wheels 1901 placed at least partially within wheel receptacles/cavities 1919 of one or more wheel castellations 1902 (e.g., which may include a chamfered and/or an arcuate/tapered profile as described herein). The wheel receptacles/cavities 1919 may be positioned such that the wheels 1901 are located away from the sides 1921 (e.g., the left and right lateral sides) of the nozzle. Thus, the dimensions of the wheel castellations 1902 should allow the inclusion of the wheels 1901.

During operation of a vacuum cleaner, wheels 1901 that are forward of the dirty air inlet are exposed to debris. In order to reduce and/or generally prevent the wheels 1901 from clogging with debris, at least the top and/or upper portion of the wheels 1901 (e.g., the portion of the wheel 1901 above the axis of rotation) is enclosed/surrounded by the nozzle (e.g., disposed within the wheel receptacles/cavities 1919). In at least one example, at least 75% of the wheel 1901 is disposed within the wheel receptacles/cavities 1919. If the one or more wheels 1901 are located on the lateral sides 1921 of the suction nozzle, then the enclosure of the wheel 1901 by the suction nozzle constraints the ranges of shapes for the side castellations 1903. Furthermore, the side castellations 1903 may need to accommodate other hardware such as attachment points, leaving relatively small amount of room for the one or more wheels 1901. In the present embodiment, the side castellations 1903 allow for improved edge cleaning without having to necessarily accommodate wheels.

Figure 19A:
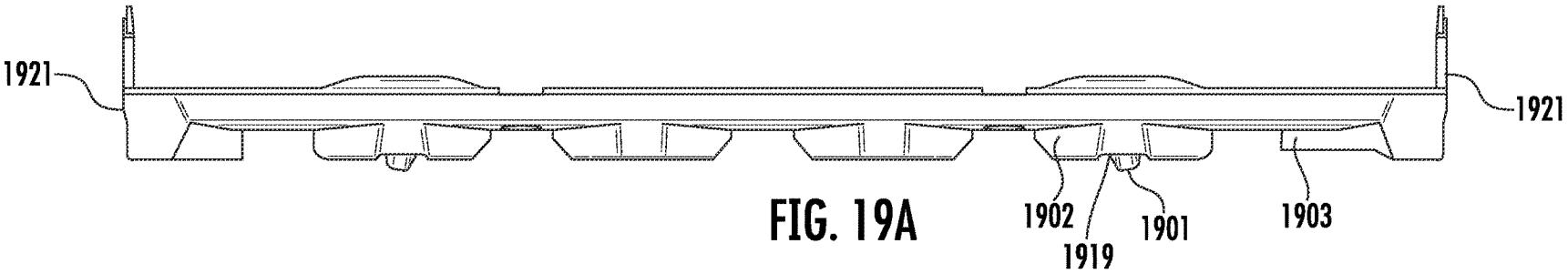
FIG. 19A is a front view of the leading edge of a vacuum cleaner nozzle with castellations and cambered wheels, consistent with embodiments of the present disclosure.
Figure 19B:
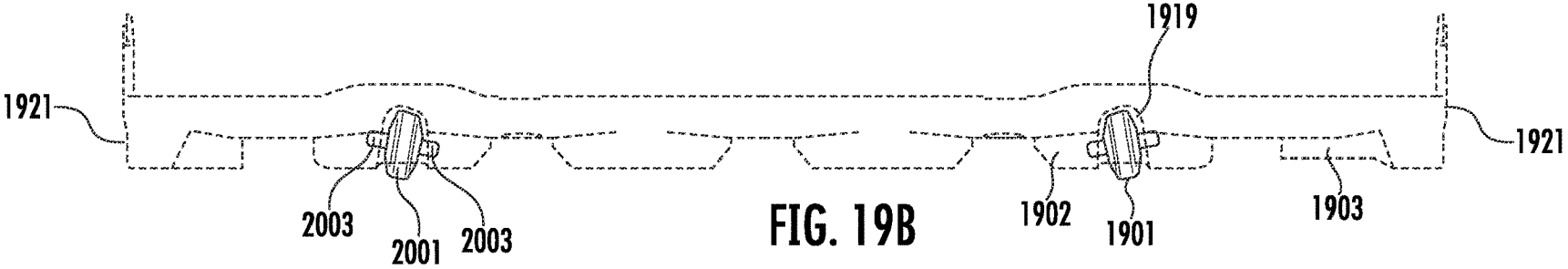
FIG. 19B is a semi-transparent view of the leading edge of a vacuum cleaner nozzle FIG. 19A, showing the cambered wheels within the castellations.
Figure 19C:
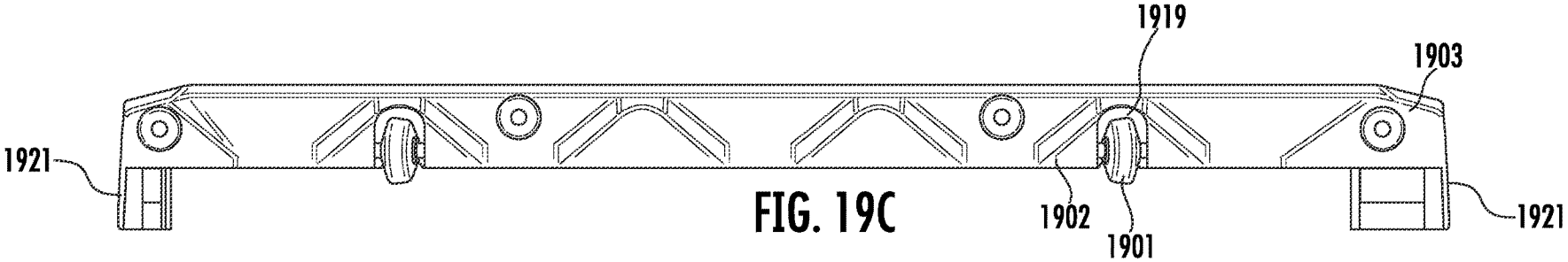
FIG. 19C illustrates a bottom view of the semi-transparent leading edge of a vacuum cleaner nozzle of FIG. 19B, consistent with embodiments of the present disclosure.
Figure 19D:
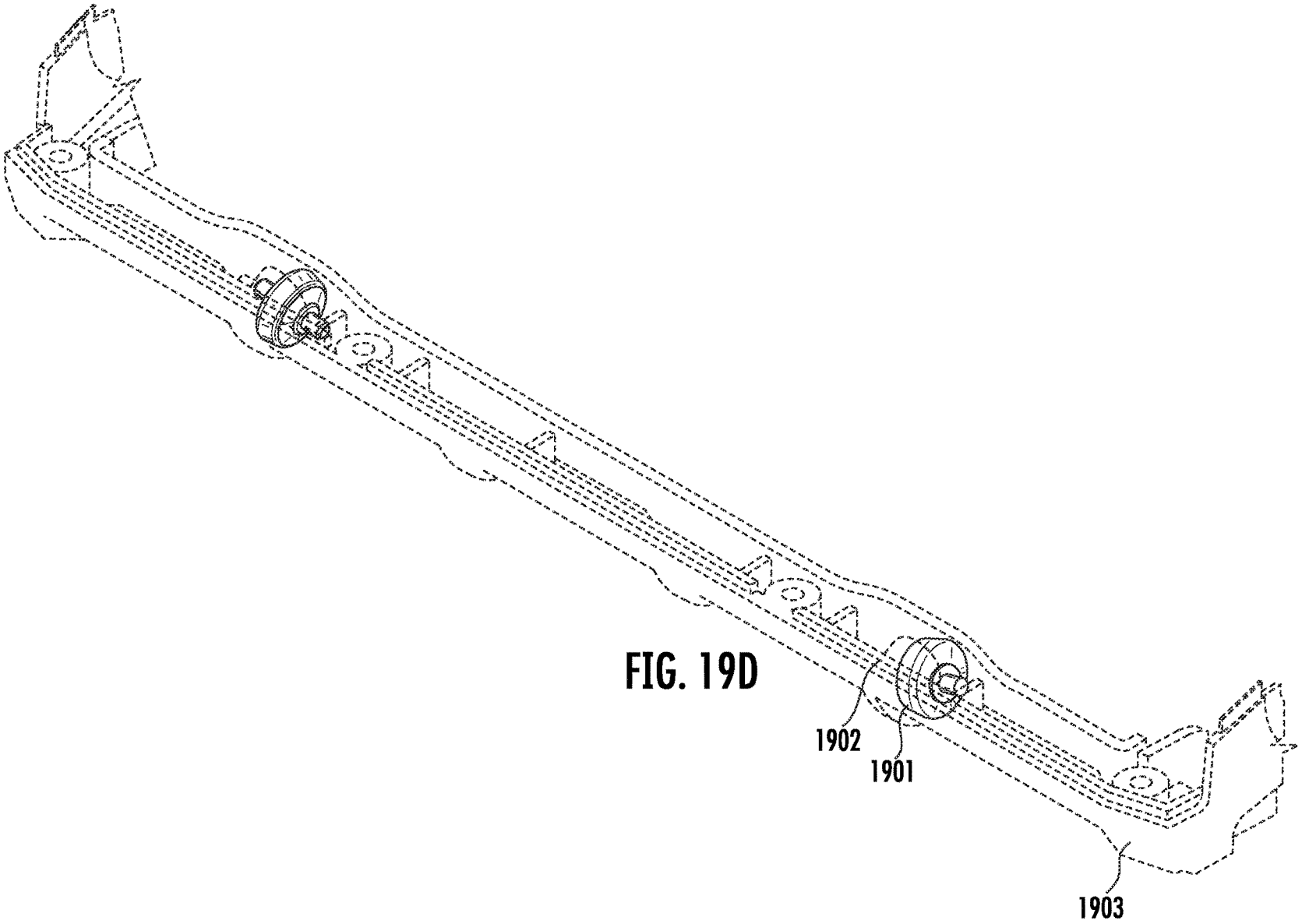
FIG. 19D illustrates an isometric view of the semi-transparent leading edge of a vacuum cleaner nozzle of FIG. 19B, consistent with embodiments of the present disclosure.
Figure 20A:
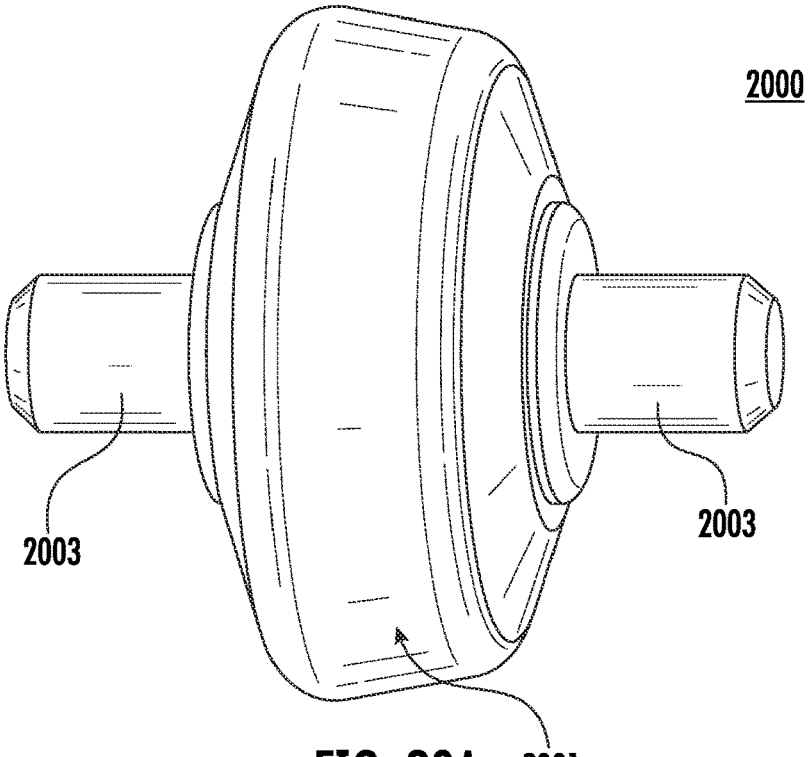
FIG. 20A is a front view of a cambered wheel, consistent with embodiments of the present disclosure.
Figure 20B:
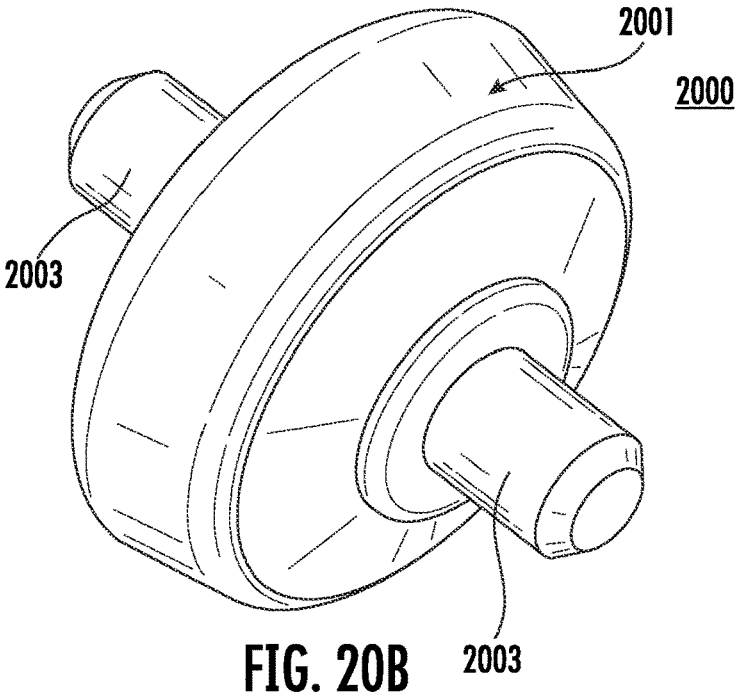
FIG. 20B is an isometric view of a cambered wheel, consistent with embodiments of the present disclosure.

As shown in FIGS. 20A-20B, the one or more wheels shown in FIGS. 19A-19D may be cambered wheels 2000. Camber is the angle at which the wheel stands relative to the floor. Put another way, camber is it is the angle between the vertical axis of a wheel and the vertical axis of the nozzle when viewed from the front or rear. In the present embodiment, the wheels 2000 may have a negative camber (e.g., static negative camber) such that the top of each wheel 2000 is leaned in closer to the center of the suction nozzle when not in motion. Camber angle alters the handling qualities of a particular suspension design; in particular, negative camber improves grip while in motion. In general, each wheel 2000 operates independently and rolls in an arc. When both wheels 2000 have symmetrical negative camber (i.e., the wheels 2000 at opposite lateral ends of the nozzle), the lateral forces substantially cancel each other out. Thus, a user can easily steer the cleaning device during operation, and there is an improved perception of control due to the increased "grip." The cambered wheels 2000 may be at least partially disposed within the wheel receptacles/cavities (e.g., wheel receptacles/cavities 1919).

In addition to the perception of control, the noise generated during the operation of a vacuum cleaner can have a significant impact on user experience. Increased noise, particularly noise not associated with a suction motor, is seen as a negative and undesirable quality. Wheel chatter (that is the noise created by the wheels of the vacuum cleaner during operation) should be reduced as much as possible. The cambered wheels 2000 of the present embodiment allow for decreased wheel chatter during operation.

The cambered wheels 2000 generate force substantially perpendicular to the direction of travel. This force results in the cambered wheels 2000 being pushed into the wheel housings on the nozzle. Since one of the sources of wheel chatter noise is the knocking of wheels against the housing, cambered wheels 2000 limit the range of motion of the wheels relative to the housing. As may be seen, the cambered wheels 2000 may have a floor contacting surface 2001 that has a generally frustoconical or tapered profile. In particular, the conical profile may be arranged such that the diameter of the floor contacting surface 2001 reduces when moving from a lateral side of the nozzle (e.g., side 119) towards the center of the nozzle. The conical profile of the floor contacting surface 2001 may allow the wheel 2000 to have negative camber and to be made from a generally solid material, while increasing the contact surface area of the floor contacting surface 2001 of the wheel 2000. The cambered wheels 2000 may rotate about one or more pins or axles 2003, for example, that pass through the center of the cambered wheels 2000. The pins 2013 may be mounted within the wheel receptacles/cavities (e.g., wheel receptacles/cavities 1919) such that the pins 2013 (e.g., the axis of rotation of the cambered wheels 2000) are arranged at an angle that generally corresponds to the camber angle (e.g., as shown in FIG. 19B) of the cambered wheels 2000.

Figure 21A:
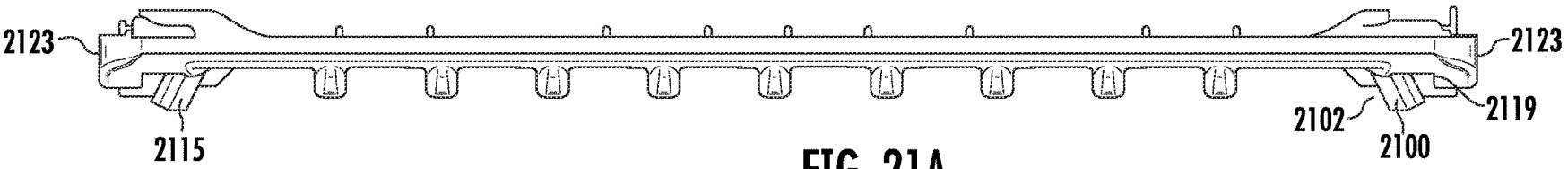
FIG. 21A is a front view of the leading edge of a vacuum cleaner nozzle with cambered, cantilevered wheels, consistent with embodiments of the present disclosure.
Figure 21B:
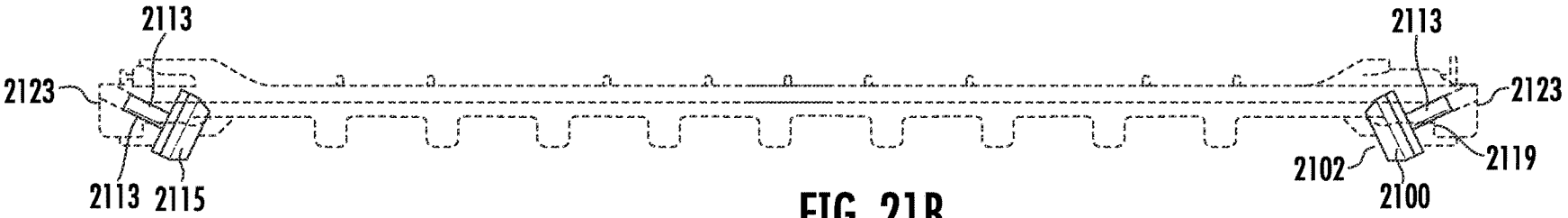
FIG. 21B is a semi-transparent view of the leading edge of a vacuum cleaner nozzle FIG. 21A, showing the cambered, cantilevered wheels.
Figure 21C:
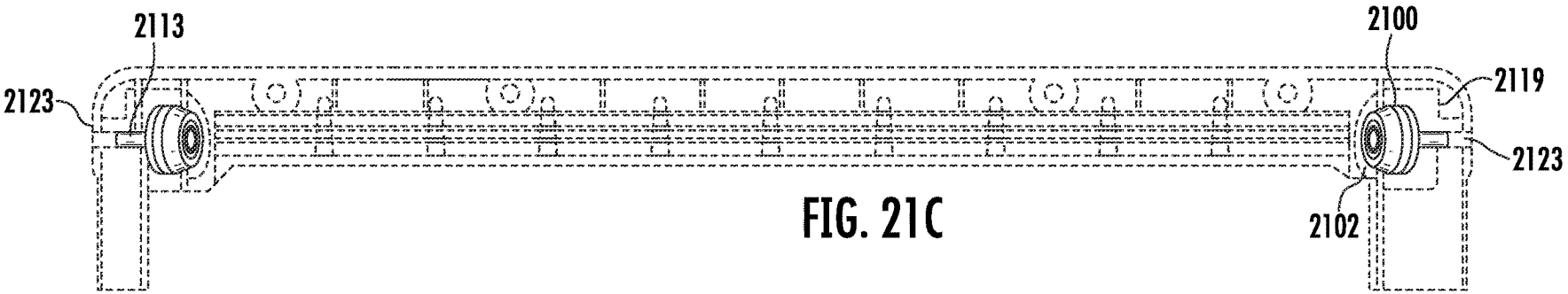
FIG. 21C illustrates a bottom view of the semi-transparent leading edge of a vacuum cleaner nozzle of FIG. 21B, consistent with embodiments of the present disclosure.
Figure 22A:
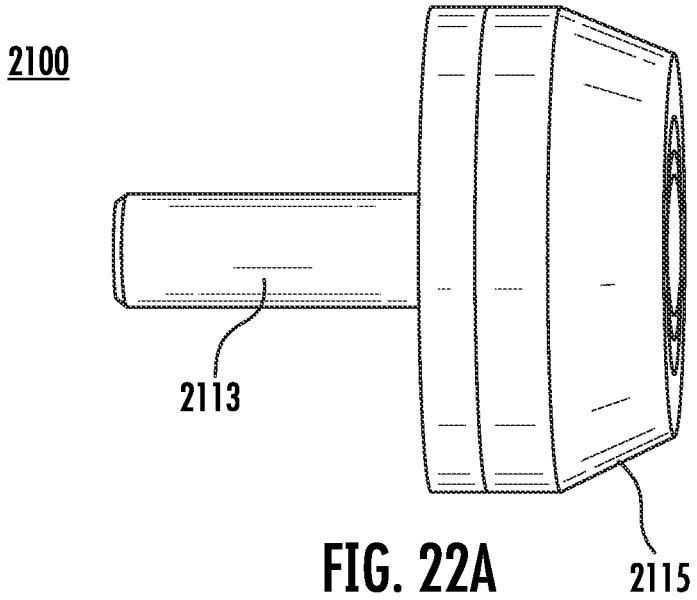
FIG. 22A is a front view of a cambered, cantilevered wheel, consistent with embodiments of the present disclosure.
Figure 22B:
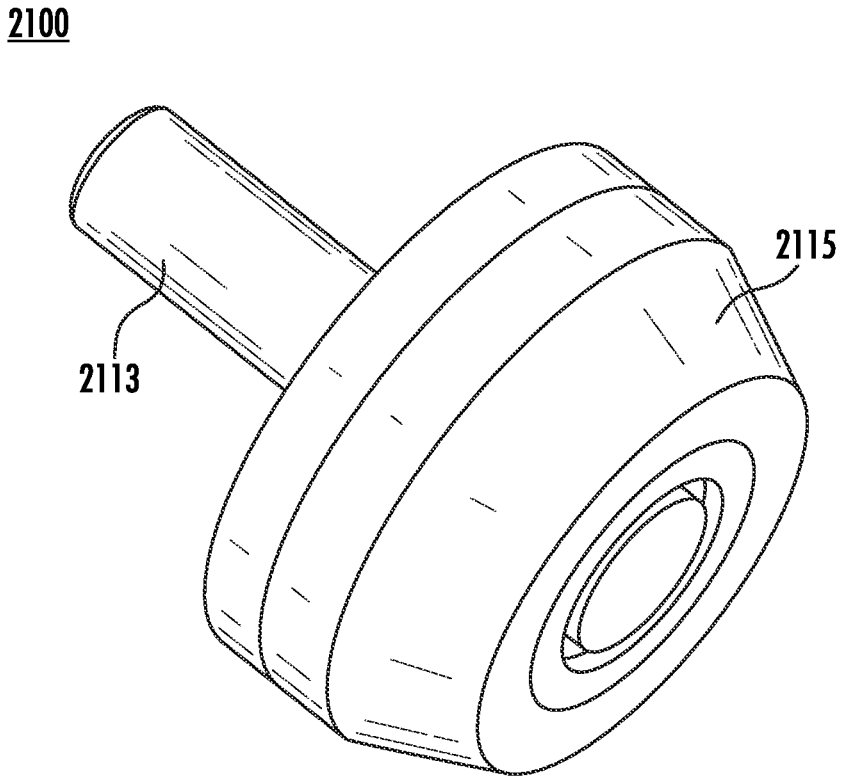
FIG. 22B is an isometric view of a cambered, cantilevered wheel, consistent with embodiments of the present disclosure.

As shown in FIGS. 21A-21C and in FIGS. 22A-22B, one or more wheels 2100 shown may extend from one end of a pin or axle 2113 such that the wheels 2100 are cantilevered. Some embodiments, the cantilevered wheels 2100 may also be cambered as described herein (e.g., having a generally frustoconical or tapered floor contacting surface 2115). In some instances, cantilevered wheels 2100 may be disposed within the wheel receptacles/cavities 2119 such that the wheels 2100 are completely underneath the nozzle (e.g., are not exposed on from the side of the nozzle when viewed from the top of the nozzle).

During operation of a vacuum cleaner, wheels 2100 that are in front of the dirty air inlet are exposed to debris. In order to reduce and/or generally prevent the wheel from clogging with debris, at least the top and/or upper portion of the wheel 2100 (e.g., the portion of the wheel 2100 above the axis of rotation) is enclosed/surrounded by the nozzle (e.g., disposed within the wheel receptacles/cavities 2119). In at least one example, at least 80% of the wheel 2100 is disposed within the wheel receptacles/cavities 2119. If the one or more wheels 2100 are located on the lateral sides of the suction nozzle, then the enclosure of the wheel 2100 by the suction nozzle constrains the ranges of shapes for the side wheel cavity 2119.

In the present embodiment, the fixed end of the cantilevered wheels 2100 (e.g., the end of the axle 2113 opposite the wheel 2100) is towards the exterior edge (e.g., left/right lateral sides 2123) of the suction nozzle. The placement of the wheel cavities 2119 allow the cantilevered axles 2113 to be supported from the exterior or lateral edge/side 2123 of the nozzle. In the embodiment shown in FIGS. 21A-21C, the cantilevered wheels 2100 have a static negative camber of approximately 25 degrees. A camber angle of 15 degrees to 70 degrees allows the wheel 2100 to spin freely on the cantilevered axle 2113.

Hair wrapping around wheel axles 2113 has a negative impact on user experience. Hair forming tight loops around an axle 2113 can interfere with the steering of the vacuum cleaner in addition to being visually unappealing. The use of a cantilevered wheel 2100 improves the ability to remove hair wrapped around the axle 2113 or wheel 2100. A gap 2102 between the axle 2113 and the wheel housing (e.g., the wheel cavity 2119) provides a space in which hair may move and then be removed.

The camber in the present invention further decreases the effect of hair wrap. During normal operation, cambered wheels 2100 generate force substantially perpendicular to the direction of travel. This force pushes hair wrapped towards the non-fixed side of the cantilevered wheel 2100. Hair caught in the wheel 2100 falls off the wheel 2100 through the gap 2102 and then may be pulled into the dirty air inlet during operation.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus and/or agitator may embody any one or more of the features contained herein and that the features may be used in any particular combination or sub-combination. Modifications and substitutions by one of ordinary skill in the art are considered to be within the scope of the present invention, which is not to be limited except by the claims.

What is claimed is:

1. A suction nozzle for use with a vacuum cleaner, the suction nozzle comprising:

a nozzle housing having a front portion, a rear portion and a dirty air inlet on a bottom surface;

a plurality of castellations extending from the nozzle housing to form a plurality of air inlets for receiving debris, each of the plurality of castellations includes a first and a second sidewall each extending substantially rearwardly from a leading edge at a hull angle, the leading edge disposed proximate to the front portion of the nozzle housing, the first and second sidewalls each including a non-chamfered portion extending downwardly from the bottom surface of the nozzle housing and a chamfered portion extending downwardly from the non-chamfered portion, wherein a horizontal spacing between the chamfered portions of adjacent sidewalls of adjacent castellations increases as the vertical distance from the bottom surface of the nozzle housing increases;

a first and a second wheel receptacle formed by at least a portion of a first and a second of the plurality of castellations, respectively; and a first wheel and a second wheel partially disposed within the first and second wheel receptacles, respectively, the first and second wheels each have a negative camber angle and each having a floor contact surface having a linearly tapered surface disposed at an angle substantially parallel to a floor surface when the suction nozzle is disposed on the floor surface.

2. The suction nozzle of claim 1, wherein the hull angle being between 90 and 130 degrees.

3. The suction nozzle of claim 1, wherein the plurality of castellations are disposed at a uniform offset distance relative to each other.

4. The suction nozzle of claim 1, wherein the suction nozzle is part of a robot vacuum cleaner.

5. The suction nozzle of claim 1, wherein the suction nozzle is part of a hand-held vacuum cleaner.

6. The suction nozzle of claim 1, wherein a height of the chamfered portion is larger than a height of the non-chamfered portion.

7. A suction nozzle for use with a vacuum cleaner, the nozzle comprising: a nozzle housing having a front portion, a rear portion and a dirty air inlet on a bottom surface;

a plurality of castellations extending from the nozzle housing, the plurality of castellations having an arcuate profile defined by at least two sidewalls each extending from a rear end and meeting at a tip, wherein the tips of the castellations are further from the dirty air inlet than the rear ends of the castellations, and wherein the at least two sidewalls each include a non-chamfered portion extending downwardly from the bottom surface of the nozzle housing and a chamfered portion extending downwardly from the non-chamfered portion, wherein a horizontal spacing between the chamfered portions of adjacent sidewalls of adjacent castellations increases as the vertical distance from the bottom surface of the nozzle housing increases increase; and castellation air inlets defined, at least in part, by adjacent pairs of the plurality of castellations, each of the castellation air inlets having a tapered profile that includes a first width at the tips of the adjacent pairs of the plurality of castellations and a second width proximate at the rear ends of the adjacent pairs of the plurality of castellations, the first width being greater than the second width;

a first and a second wheel receptacle formed by at least a portion of a first and a second of the plurality of castellations, respectively; and a first wheel and a second wheel partially disposed within the first and second wheel receptacles, respectively, the first and second wheels each have a negative camber angle and each having a floor contact surface having a linearly tapered surface disposed at an angle substantially parallel to a floor surface when the suction nozzle is disposed on the floor surface.

8. The suction nozzle of claim 7, wherein the sidewalls of at least one of the plurality of castellations extend substantially relative to each other at a hull angle, the hull angle being between 90 and 130 degrees.

9. The suction nozzle of claim 7, wherein the plurality of castellations extend along at least a portion of a leading edge of the nozzle housing.

10. The suction nozzle of claim 7, wherein the suction nozzle is part of a robot vacuum cleaner.

11. The suction nozzle of claim 7, wherein the suction nozzle is part of a hand-held vacuum cleaner.

12. The suction nozzle of claim 7, wherein a height of the chamfered portion is larger than a height of the non-chamfered portion.

* * * * *